US007563097B2

(12) United States Patent
Lavigna et al.

(10) Patent No.: US 7,563,097 B2
(45) Date of Patent: Jul. 21, 2009

(54) STABILIZING HAND GRIP SYSTEM

(75) Inventors: Christopher Lavigna, Olney, MD (US); Diann Brei, Milford, MI (US); Jonathan Luntz, Ann Arbor, MI (US); Anupam Pathak, Ann Arbor, MI (US)

(73) Assignees: Techno-Sciences, Inc., Lanham, MD (US); The Regents of the University of Michigan, Ann Arbor, MI (US)

( * ) Notice: Subject to any disclaimer, the term of this patent is extended or adjusted under 35 U.S.C. 154(b) by 772 days.

(21) Appl. No.: 11/218,583

(22) Filed: Sep. 6, 2005

(65) Prior Publication Data

US 2006/0194173 A1 Aug. 31, 2006

Related U.S. Application Data

(60) Provisional application No. 60/606,931, filed on Sep. 3, 2004.

(51) Int. Cl.
*F41A 33/00* (2006.01)

(52) U.S. Cl. ..... 434/16; 434/18; 42/90; 42/94; 42/124; 42/125; 42/126

(58) Field of Classification Search ..... 434/16, 434/18; 42/90, 94, 124, 125, 126
See application file for complete search history.

(56) References Cited

U.S. PATENT DOCUMENTS 3,165,972 A * 1/1965 Cumbo ..... 89/14.05
3,184,877 A * 5/1965 Andrews ..... 42/72
4,480,524 A * 11/1984 Blomqvist et al. ..... 89/41.16
4,558,627 A * 12/1985 LeBlanc et al. ..... 89/41.03
4,986,018 A * 1/1991 McDonald, Jr. ..... 42/1.06
5,013,276 A * 5/1991 Garfinkel ..... 446/14
5,413,028 A * 5/1995 Ng et al. ..... 89/41.09
5,413,029 A * 5/1995 Gent et al. ..... 89/41.03
5,520,085 A * 5/1996 Ng et al. ..... 89/41.03
5,631,437 A * 5/1997 LaVigna et al. ..... 89/14.3
5,834,677 A * 11/1998 Muller ..... 89/41.17
5,963,749 A * 10/1999 Nicholson ..... 396/421
5,974,940 A * 11/1999 Madni et al. ..... 89/41.17
6,487,807 B1 * 12/2002 Kopman et al. ..... 42/94

(Continued)

OTHER PUBLICATIONS

Shahinpoor, Mohsen, "Micro-Electro-Mechanics of Ionic Polymeric Gels As Electrically Controllable Artificial Muscles", Journal of Intelligent Material Systems and Structures, vol. 6, May 1995.

(Continued)

*Primary Examiner*—Kathleen Mosser
*Assistant Examiner*—Jerry-Daryl Fletcher
(74) *Attorney, Agent, or Firm*—DLA Piper LLP (US)

(57) ABSTRACT

In a self-contained actively-controlled stabilization system within a hand-grip, all components are contained within the handgrip, and one generic handgrip can be attached to a variety of devices for a wide range of applications, thereby increasing portability, reducing weight and bulkiness, and decreasing complexity and application dependence. The handgrip includes a sensor, a controller and an actuator which preferably employs at least one shape memory alloy wire. The actuator drives a platform mechanism which may be configured such that the elevation and azimuth degrees of freedom are coupled or uncoupled. Direct, rotational and other platform mechanisms may be used with the invention.

24 Claims, 22 Drawing Sheets

U.S. PATENT DOCUMENTS

| | | | | |
|---|---|---|---|---|
| 6,497,171 | B2 * | 12/2002 | Gerber et al. | 89/41.09 |
| 6,652,350 | B1 * | 11/2003 | Phillips | 446/330 |
| 6,901,691 | B1 * | 6/2005 | Little | 42/118 |
| 7,121,034 | B2 * | 10/2006 | Keng | 42/71.01 |

OTHER PUBLICATIONS

"Sniper Training", Field Manual, No. 23-10, Aug. 1994.

"Rifle Marksmanship M16A1, M16A2/3, M16A4, and M4 Carbine", Department of the Army, FM 3-22.9 (FM23-9), Apr. 2003.

"Doctrine for Joint Urban Operations", Joint Publication 3-06, Sep. 16, 2002.

Tobushi, Hisaaki, et al., "Notice Concerning Copyright Restrictions", Japan Society of Mechanical Engineers. Transactions. Series A, vol. 57, Issue No. 543, 1991.

Lieutenant Colonel William C. David, "Preparing a Battalion for Combat: Marksmanship", Infantry, Jul.-Aug. 1995.

S. J. Murray, et al., "6% Magnetic-Field-Induced Strain by Twin-Boundary Motion in Ferromagnetic Ni-Mn-Ga", American Physics Letters, vol. 77, No. 6, Aug. 7, 2000.

Diann Brei, et al., "Actuation Development and Evaluation for INSTAR-Inertially Stabilized Rifle", Smart Structures and Integrated Systems, Proceedings of SPIE, vol. 5056, 2003.

Brian Barnes, et al., "Development of an Antagonistic SMA Actuator for Instar Rifle Stabilization System", Proceedings of IMECE 2005, IMECE2005-81700, 2005 ASME International Mechanical Engineering Congress and Exposition, Nov. 5-11, 2005.

Diann Brei, et al., "Development and Demonstration of INSTAR-Inertially Stabilized Rifle", Smart Structures and Materials 2003: Smart Structures and Integrated Systems, Proceedings of SPIE, vol. 5056, 2003.

Q. M. Zhang, et al., "Giant Electrostriction and Relaxor Ferroelectric Behavior in Electron-Irradiated Poly(vinylidene fluoride-trifluoroethylene) Copolymer", Science, vol. 280, Jun. 1998.

James H. Mabe, et al., "NiTinol Performance Characterization and Rotary Actuator Design", Smart Structures and Materials 2004: Industrial and Commercial Applications of Smart Structures Technologies: Proceedings of SPIE, vol. 5388, 2004.

J. A. Shaw, et al., "On The Nucleation and Propagation of Phase Transformation Fronts In A NiTi Alloy", Acta mater., vol. 45, No. 2, 1997.

Inderjit Chopra, "Review of Current Status of Smart Structures and Integrated Systems", SPIE, vol. 2717, 1996.

John A. Shaw, "Simulations of Localized Thermo-Mechanical Behavior in a NiTi Shape Memory Alloy", International Journal of Plasticity, vol. 16, 2000.

John A. Shaw et al., "Thermomechanical Aspects Of NiTi", Journel of Mechanical Physics and Solids, vol. 43, No. 8, 1995.

* cited by examiner

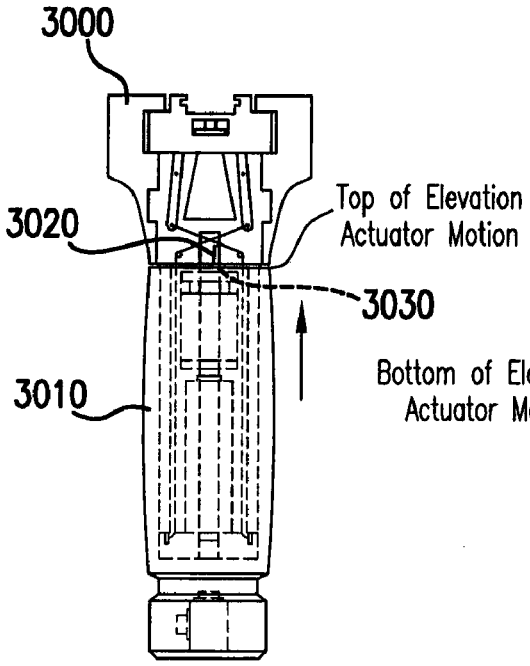
FIG.3b(1)
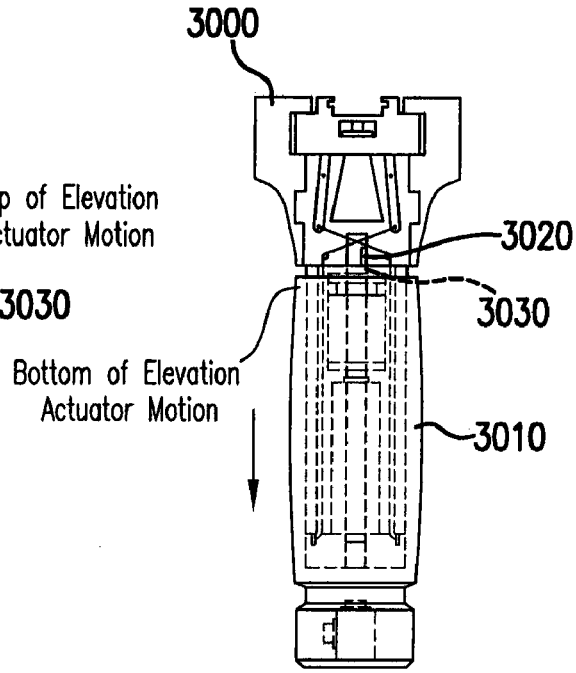
FIG.3b(2)
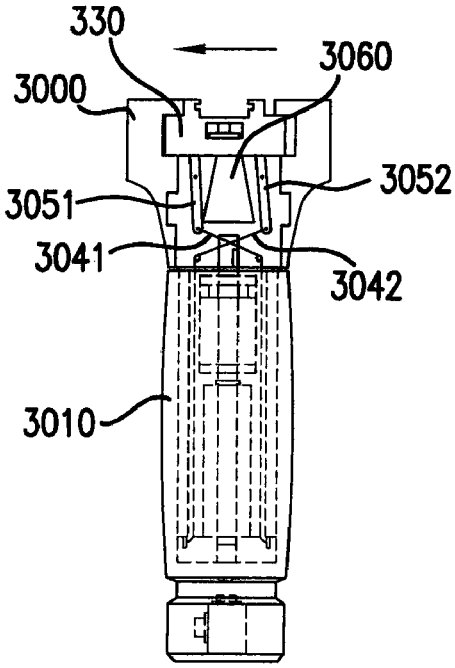
FIG.3c(1)
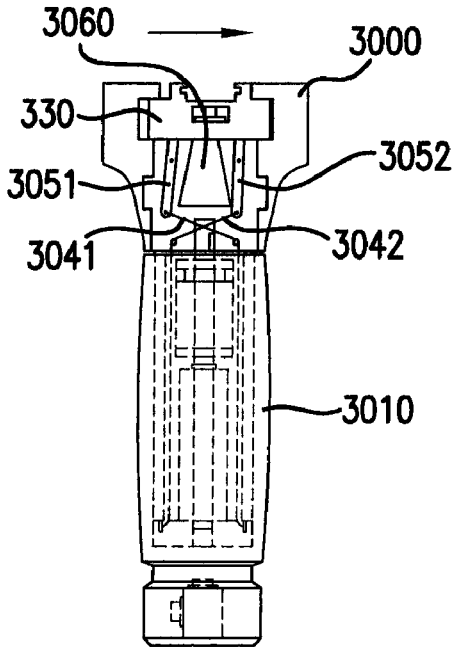
FIG.3c(2)

Or

ANTAGONISTIC

SINGLE WIRE

STABILIZING HAND GRIP SYSTEM

This application claims the benefit of U.S. Provisional Application Ser. No. 60/606,931, entitled "Stabilizing Gun Hand Grip System (SGGS)," filed Sep. 3, 2004, the contents of which are hereby incorporated herein by reference.

This invention was made with Government support under Contract No. W15QKN-04-C-1131 awarded by the Department of the Army. The Government may have certain rights in the invention.

BACKGROUND

Active stabilization platforms are useful for many applications which require a hand-held device to maintain a steady point of aim such as: camera systems, binoculars, surgical instruments, surveyor's tools, and weapon systems. Hand-held platforms can be greatly improved by an actuated mechanism operating between the point at which the operator holds the device and the aiming point of the device, to cancel relatively high frequency jitter motions induced by the arms and body, but allowing relatively low frequency intentional aiming motions.

One of many applications for a hand-held active stabilization system is small arms (e.g., pistols and rifles) stabilization to improve marksmanship. Good marksmanship is essential for the success of modern infantry forces in combat [a,b]. It is indispensable for effective infantry operations in urban environments, which has been noted as the battlefield in which future U.S. military operations are to occur [c]. Combat in these urban warfare environments place high demands on accurate fire due to the intermingling of civilians and combatants, the close proximity of enemy forces, and the ever varying urban landscape. In such environments, good marksmanship skills significantly improve a soldier's survivability. This was one of the most important lessons learned from a recent urban warfare operation, the battle in Mogadishu, Somalia, in 1993, where well-aimed, accurate fire enabled a small, highly trained U.S. force to hold off thousands of Somali militiamen during urban combat operations [d]. It is important to note that the soldiers who participated in the Somalia operation were elite forces including elements of the Delta Force, Seals and Army $10^{th}$ Mountain division, and their considerable marksmanship skills significantly exceed those of the average infantry soldier.

The U.S. Army has long recognized the importance of good marksmanship skills as they relate to soldier survivability and has established marksmanship training and qualification programs to teach these skills to the infantry soldier [a,b]. However, attaining and maintaining proficiency in marksmanship is a costly, resource and time consuming process with varying degrees of effectiveness. Even with the extensive training, a significant number of soldiers are not able to attain the Expert, or higher levels of marksmanship qualification. It has also been shown that in actual combat situations, which cannot be effectively simulated in training, this deficiency hampers their ability to perform on the battlefield and thereby limits the combat related tasks they can perform. To address this deficiency there exists a need to improve the shooting performance of these lesser skilled soldiers by methods other than the standard formal marksmanship training, which in these cases has proven to be ineffective.

In combat situations, even for the best trained and talented shooters, it is often difficult to perform the fundamentals inherent in good marksmanship techniques, which include assuming and maintaining a steady position, aiming, controlling breathing and executing a proper trigger squeeze [a,b]. For example, in combat, the terrain and time frame of the immediate circumstances often dictate the choice of shooting position including the availability of steadying supports. Because of this, the shooter does not always have the time or luxury of choosing a steady prone position with sandbag support for the weapon. He or she must react to the situation and assume the most expedient position from which to deliver fire. Often this means employing a position that is not optimal from a steadying standpoint, making it more difficult and time consuming to steady the rifle for fire.

It is estimated by the Army that 90% of the errors contributing to a shooter missing his or her intended target in range qualification can be attributed to aiming errors which include shooter induced disturbances, inaccurate range and wind estimation, and weapon anomalies. In these non combat situations, shooter induced disturbances account for approximately 20% of this error [f]. Further complicating the shooting task is that, when subjected to the stress of combat, the shooting accuracy of all soldiers degrades. According to U.S. Army Small Arms Program personnel, the levels of shooter induced disturbances in combat situations are typically at least an order of magnitude higher than those seen in non-combat situations [e]. This is echoed by U.S. Army Joint Service Small Arms Program (JSSAP) program manager Steve Mango when describing the effects of combat stress on the soldier's performance using the M16. "The M16 is a very accurate weapon. However, when it is placed in the hands of an individual under combat-stress conditions, its performance is reduced dramatically."[g]

Another area in which the U.S. Army has identified a deficiency in marksmanship at the squad level is the ability to engage targets between the maximum range of the average soldier, 300 meters, and the typical range of trained snipers, 600 meters and beyond [e]. To address this need the U.S. Army has develop the Squad Designated Marksman Program (SDM). The primary mission of the SDM is to deploy as a member of the rifle squad. The SDM is not a squad sniper but fires and maneuvers with his/her squad and performs all of the duties of a rifleman. His/her secondary mission is to engage targets from 300-500 meters with effective, well aimed fires using a standard weapon and ammunition. The SDM may not have an optic sight and therefore, must possess a significant mastery of marksmanship. In order to meet the personnel needs arising from placing an SDM in each squad, a significant number of soldiers highly skilled and trained in marksmanship will be required.

In combat, physiological responses with direct effect on gun aiming performance such as heart beat, respiration, and muscle jerk motion increase significantly and interfere with a soldier's ability to keep the gun aimed on target [h,i]. To attain accurate fire from small arms weapons, such as assault or sniper rifles, the shooter must maintain extremely precise control over the weapon point of aim during the aiming and firing process. For example, to hit a standard military man-sized target silhouette at 300 m, the shooter must control the deviation in the gun angular orientation (both elevation and azimuth angles) to within ±0.83 mrad (±0.09°) of the nominal orientation (rifle aim point at the center of target). Of course, in combat enemy forces are usually concealed and present a much smaller target than the standard silhouette shape; thereby, requiring substantially more precise control of weapon for the round to hit the target. Reducing or eliminating the shooter induced disturbances, especially in combat situations, can have a substantial impact on the accuracy of fire. Despite all the advances in technology over the past century, there have been very few changes introduced into military rifles to address this problem.

Thus, there exists a need for a method and apparatus for stabilizing hand held devices such as small arms and other weapon systems, cameras, binoculars, surgical instruments, surveyor's tools, and the like.

SUMMARY

The foregoing need is addressed to a great extent by a self-contained actively-controlled stabilization system within a hand-grip, which is totally independent of the application. All components are contained within the handgrip, and one generic handgrip can be attached to a variety of devices for a wide range of applications, thereby increasing portability, reducing weight and bulkiness, and decreasing complexity and application dependence. In one embodiment, an active stabilizing handgrip (which is preferably either vertically or horizontally mounted) is attached to a barrel of a rifle or other hand-held small arms device. In another embodiment, an active stabilizing vertical handgrip is attached to the forward tripod mount on a long camera lens, providing a holding point which senses and cancels out body and arm jitter, maintaining a steady aim, and allowing more portability than a tripod. In still other embodiments, either vertical or horizontal active stabilizing handgrips are attached to binoculars and telescopes. In yet other embodiments, smaller devices, such as surgical tools or writing implements for the impaired (such as Parkinson's disease), are also stabilized using axially mounted handgrips held in the fingers.

In one highly preferred embodiment, a stabilizing handgrip is attached to a gun and is held by the left or right hand for right or left handed users respectively. The handgrip employs an active inertial stabilization system to compensate for and significantly reduce unwanted gun aim point jitter (wobble). Its operation is similar in principle to image stabilization systems in hand held video cameras in that it functions to reduce the point of aim jitter generated by the user while at the same time does not affect the typical low frequency pointing (target tracking) motions required to track a target. The stabilization system preferably includes an actuator incorporating shape memory alloy wires. Examples of gun platforms with which the stabilizing handgrip may be used include the U.S. Army M24, M16 and M4 series of rifles.

BRIEF DESCRIPTION OF THE DRAWINGS

FIGS. 3*b* and 3*c* are cut away views of the handgrip of FIG. 3*a* showing elevation and azimuth activation, respectively.

DETAILED DESCRIPTION

Figure 1:
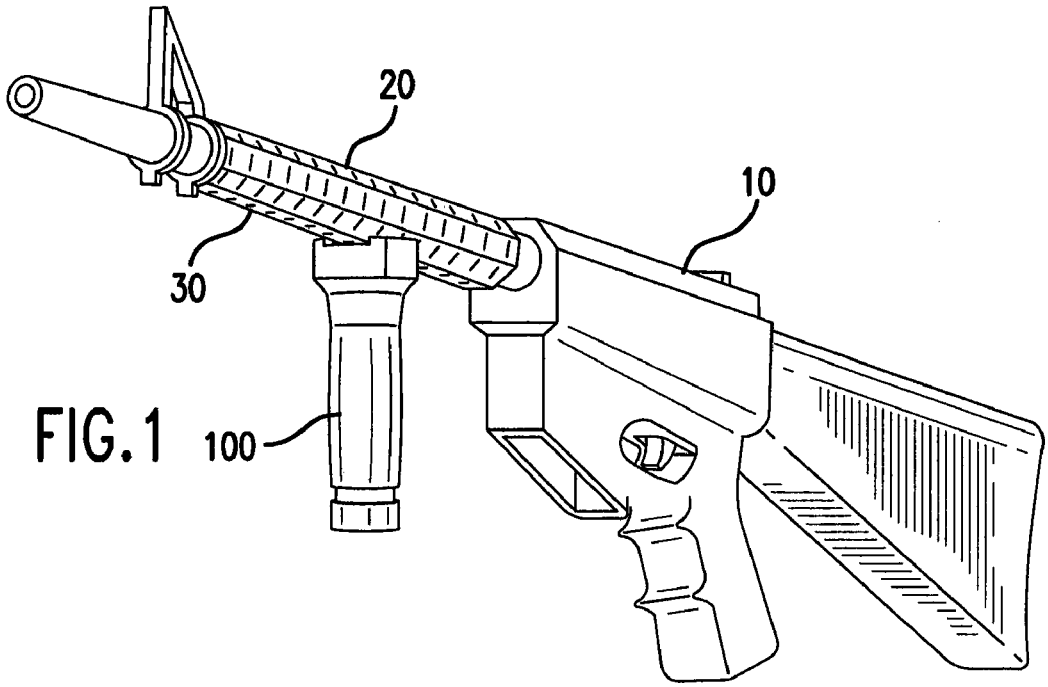
FIG. 1 is a perspective view of a stabilizing handgrip according to a first embodiment of the invention attached to an M16A4 rifle.

Various preferred embodiments of stabilizing handgrips are discussed below. Specific details, such as methods for attaching the handgrip to a device to be stabilized, actuator configurations, etc., will be set forth in order to provide a thorough understanding of the present invention. The specific embodiments described below should not be understood to limit the invention. Additionally, for ease of understanding, certain method steps are delineated as separate steps. These steps should not be understood as necessarily distinct or order-dependent in their performance.

As discussed above, the stabilizing handgrips discussed herein are applicable to a variety of hand-held devices. Each such hand-held device may have its own unique requirements; however, all of these applications share common performance parameters. Aim takes place in two degrees of freedom: azimuth and elevation. The primary purpose of the handgrip stabilization platform is to produce these two degrees of freedom motion between the stabilizing handgrip platform and the hand-held device, and the platform must be capable of producing and controlling both degrees of freedom. Being hand-held, the platform must be able to work against the weight and dynamics of the weapon, and also against the arm and body of the operator whose dynamics come into play. The design of the handgrip stabilizing platform is driven by the force and motion required, and for a particular application, the up/down (elevation), left/right (azimuth) ranges of motion, and the maximum force required in these directions must be specified. While the actual values may vary with applications, the motion amplitudes tend to be small since the stabilizer is canceling only the human generated jitter. For example, a M16 rifle elevation stabilization platform might be required to generate at most 2 mm of motion at the point of attachment with at most 8 N of force. Also of great significance is the frequency at which the motion must be generated. This also varies with application, although it will remain in the range of human-generated jitter. It is suggested that for the M16 rifle example, typical jitter disturbances occur in the range of 1 to 3 Hz.

In addition to the above-mentioned performance parameters, an important design driver is the packaging—the entire device (actuator, sensor, mechanism, platform, battery) is preferably self-contained within a handgrip. While the specific dimensions will depend on application, a typical handgrip volume is reasonable to assume. For example, a typical M16 rifle handgrip is 10 cm tall and 2.3 cm in diameter and attaches vertically underneath the barrel on a set of fixed rails. In addition to these key requirements, it is desirable that the stabilizing handgrip be lightweight, low power, and robust under extreme environments.

The general approach employed herein for meeting the design parameters discussed above is to employ active stabilization, through feedback and feed forward control, to effectively decouple small, user-induced angular movements from a centered fixed reference frame with respect to the hand-held device (e.g., a gun barrel axis for a rifle). It is important to note that small purely linear movements of a hand-held device such as a gun induced by the user have a minimal effect on the motion of the gun point of aim. For example, consider a target at 200 m from the shooter, a 1 mm side to side translation of the gun produces a 1 mm side to side motion of the gun point of aim at the target. However, for target at the same 200 m range, a small angular rotation movement of 5 millliradians rocking size to side produces a point of aim motion of 1 m side to side at the target due to the multiplicative effect of the target range.

The stabilizing handgrips discussed herein are believed to be particularly useful in connection with small arms such as rifles and hence will be discussed primarily in that context below. However, this should not be taken as an indication that the invention is limited to such applications. Rather, the invention is applicable to a wide variety of hand-held devices as discussed above.

In one preferred embodiment, the external form factor of a stabilizing handgrip platform 100 (also referred to herein as simply a "stabilizing handgrip") is similar in size and shape to the standard issue vertical pistol grip which is an accessory on the US Army standard issue M16A4 rifle 10 as shown in FIG. 1. (Another embodiment of this invention is a horizontal style hand grip aligned parallel to the gun barrel axis mounted to the Rail Mount). As is shown in FIG. 1, the stabilizing handgrip 100 is mounted to the M16A4 barrel 30 via the M5 rail adapter system (RAS) 30, which is a standard feature of both the US Army M16A4 and M4 rifles. Although the handgrip 100 is mounted vertically, it can be easily modified to take the form of a horizontal handgrip that would mount on the M5 rail system in a similar manner.

Figure 2:
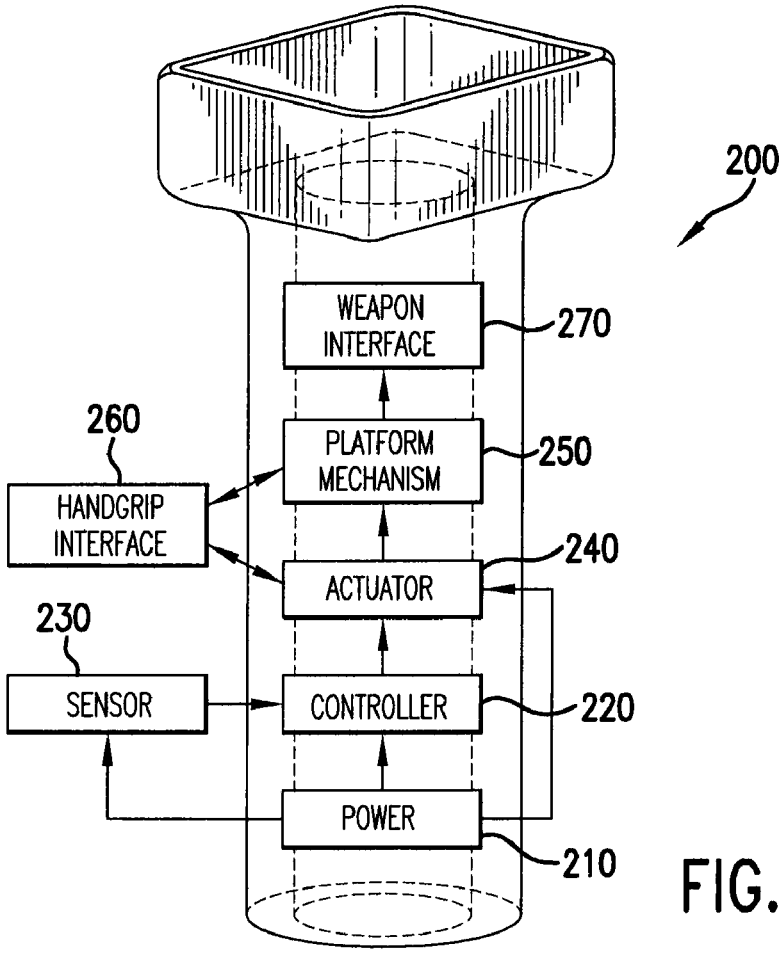
FIG. 2 is block diagram of the components of the stabilizing handgrip of FIG. 1.

A conceptual block diagram 200 of the various components of the stabilizing handgrip 100 of FIG. 1 is illustrated in FIG. 2. The components include a power source 210 that provides power to a controller 220, a sensor 230 and an actuator 240. The controller 220 inputs motion information from the sensor 230 and outputs a signal (or multiple signals) to the actuator 240. The actuator 240 exerts a mechanical force on a platform mechanism 250. The force exerted on the platform mechanism 250 by the actuator 240 is transferred to the handgrip by the handgrip interface 260, and the force exerted on the handgrip is transferred to the weapon via the weapon interface 270 respectively. Each of these components will be discussed in further detail below.

It should also be noted that is preferably activatable on demand by a rifleman through a low profile switch (not shown in FIG. 2) that is mounted on the outer surface of the grip 100. This preferred embodiment allows the rifleman to activate the system with the forearm hand with minimal effect to the aiming motion. The switch employed is sensitive enough so that activation or depressing the switch does not disrupt the gun aim.

Sensor

The sensor 230 preferably comprises miniature gyro sensors to sense the inertial angular rotation rates of the gun for feedback control and the handgrip for feedforward control. In a preferred embodiment, two gyro sensors 310, 320 are mounted in the rail mounting clamp 330, with one gyro sensor 310 mounted in alignment with the azimuth axis and another gyro sensor 320 mounted in alignment with the elevation axis to sense the gun angular rates in an inertial reference frame for feedback control. Additionally, two gyro sensors 340, 350 are mounted in the hand 350 grip structure of the invention, with one sensor 340 mounted in alignment with the azimuth axis and one sensor 350 mounted in alignment with the elevation axis to sense the user's hand inertial angular rates for feedforward control. Outputs from the four gyros 310, 320, 340, 350 are connected to inputs on the control processor 220. Preferred embodiments utilize micro electromechanical systems (MEMS) gyros (e.g., Analog Devices ADXRS 150 MEMS gyros). Other embodiments employ inertial gyros; optical gyros, fiber optic gyros, vibrating tuning fork gyros, spinning mass gyros, vibrating gyros, and gas rate gyros.

Controller

The controller 220 preferably comprises an electronic circuit board with a form factor designed to fit internally to the hand grip 100 to protect it from outside environmental damage and to allow for direct connection to the sensor(s) 230 (e.g., the gyros 310, 320, 340, 350), the power source 210, and the actuator 240. In other embodiments, the controller board 220 is mounted outboard of the hand grip 100 in a separate enclosure and is affixed to the rail mount 30 or other mounting structure on the rifle 10.

The control processor board 220 comprises micro-control units (MCU) chipsets, digital signal processor (DSP) chipsets, passive and active signal conditioning components and power supply conditioning components. The MCU/DSP chipsets contain the control software kernel that receives inputs from the sensor(s) 230 and activation switch (not shown) and outputs control signals to the actuator 240. The control kernel processes the sensor signals, executes the control algorithm and outputs actuator commands in real time. Control algorithms to perform these required functions are based on Linear Quadratic Gaussian (LQG), Linear Quadratic Regulator (LQR), H-infinity ($H^{\infty}$, Proportional-Integral-Derivative (PID), and Neural Networks in various embodiments.

The controller 220 algorithms are designed based on an idealized system and formulated to be robust with respect to essential system uncertainties. This approach is required because much of the uncertainty is shooter dependant and would be extremely difficult to quantify with any precision.

Because the actual barrel motion induced by the controller is very small, the azimuth and elevation degrees of freedom are decoupled. Two control configurations for the idealized system are within the scope of this invention. The first configuration is a feedback system based on feedback of the gun angular velocities as measured by rate gyros (azimuth and elevation) and local handgrip actuator displacements as measured by displacement sensors. The second configuration is a feedback/feedforward system as in the aforementioned control design with the addition of two angular rate gyros (azimuth and elevation) to provide feedforward measurements of the hand induced disturbance motion.

Figure 4A:
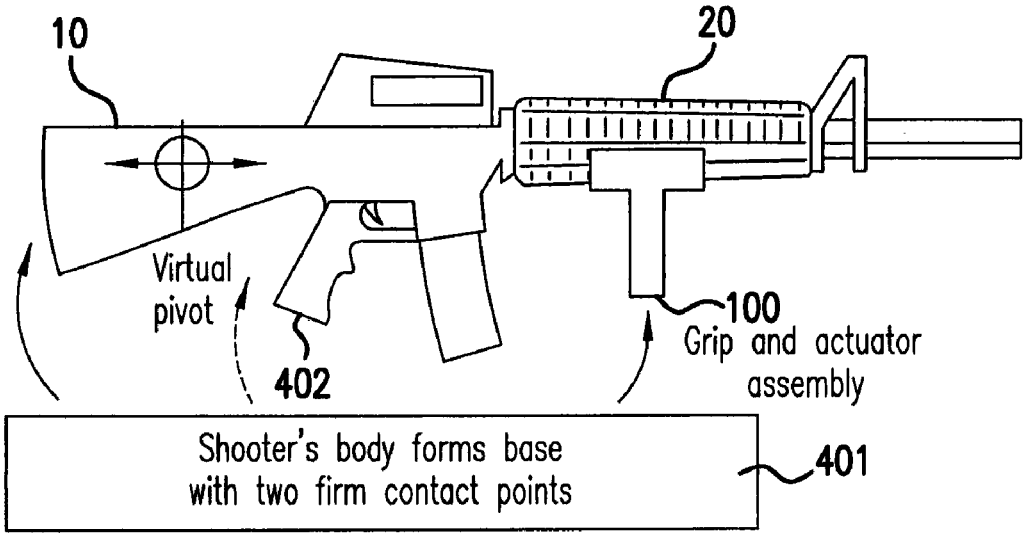
FIGS. 4*a* and *b* are side views of a rifle equipped with a stabilizing handgrip and a model of a rifle equipped with a stabilizing handgrip, respectively.
Figure 4B:
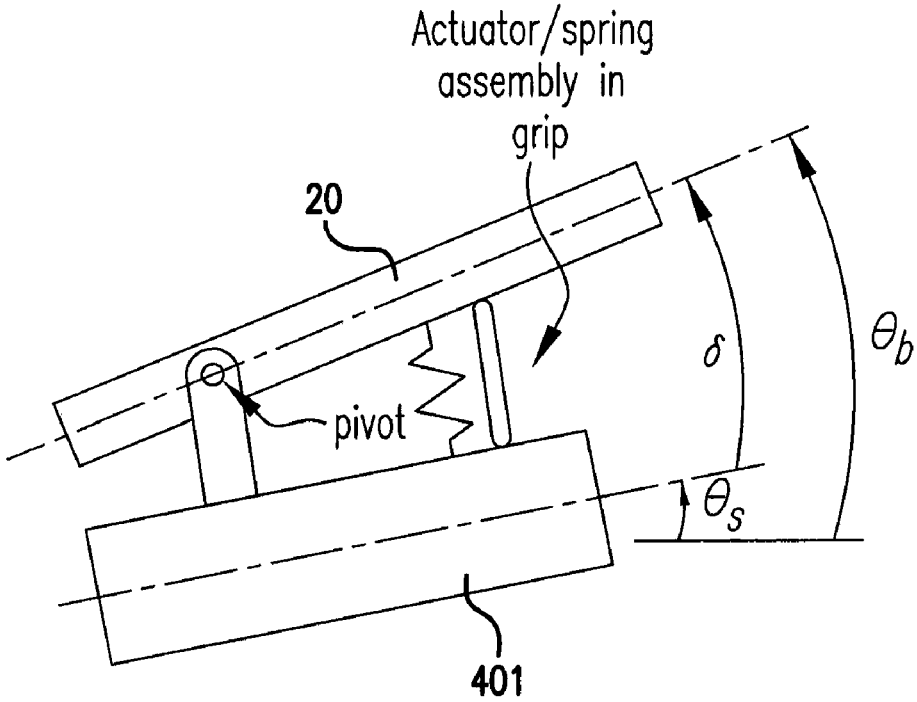

The single axis (elevation), idealized control problem is represented in FIG. 4. The base 401 is presumed to be a rigid platform composed of the shooter's body and supporting arm, and the weapon grip 402. The implications of relaxing the rigid body assumption will be addressed below. We view the base motion as a small exogenous disturbance which is to be cancelled by the stabilizer system. The handgrip stabilizer 100 is intended to maintain a fixed barrel line-of-sight; it should isolate the barrel 20 from the disturbing motion. On the other hand, large and very slow base motions (such as target tracking commands for moving targets) are assumed to be intended motions and are not rejected.

Figure 5:
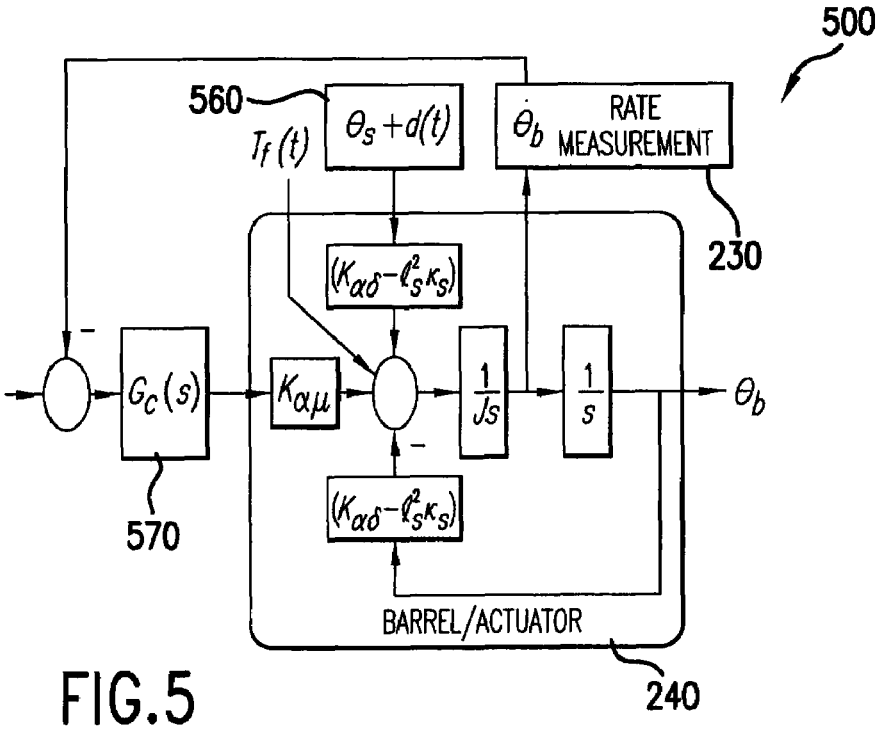
FIG. 5 is a block diagram of a feedback controller configuration according to an embodiment of the invention.

A mathematical model of the first of the two configurations discussed above, the pure feedback configuration 500, is shown in FIG. 5 for a single degree of freedom (in this case, the elevation axis). A similar configuration is used for azimuth (as discussed above, the azimuth and elevation are decoupled). The model 500 includes a sensor (preferably the gyro 310 discussed above) that measures barrel elevation angular rate, an actuator 240, and a compensator 570. The compensator 570 can be realized using any conventional technique known in the art, e.g., proportional-integral-derivative (PID) techniques or any of the other techniques listed in the following paragraph. In FIG. 5, $T_f(t)$ represents the firing torque exerted on the barrel during firing of the weapon, $\theta_b$ represents the angular position of the barrel of the weapon, $K\alpha\delta$ is actuator compliance; $\theta_s$ is angular position of gunstock; and $1/S^2K$ is restoring torque due to preload springs in actuator.

Figure 6:
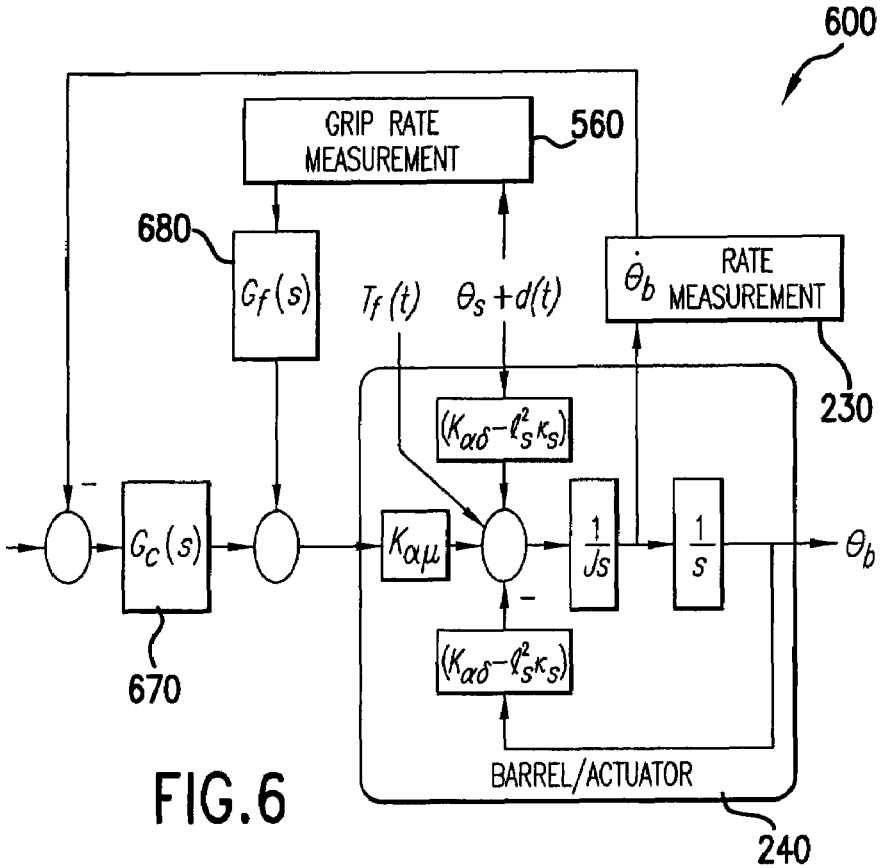
FIG. 6 is a block diagram of a feedback/feedforward controller configuration according to an embodiment of the invention.

A mathematical model 600 of the feedforward/feedback configuration, shown in FIG. 6, includes a sensor (preferably the gyro 310 discussed above) that measures barrel elevation angular rate, a second sensor (preferably the gyro 350 discussed above) that measures grip (base) angular rate, an actuator 240, a feedback compensator 670, and a feed forward compensator 680. The compensator design is a robust design that takes into account two sources of uncertainty: a parametric uncertainty that reflects that the pivot point is not precisely known, and a dynamic uncertainty that reflects the fact that the base is not a rigid body. Control algorithms to perform these required functions for the controller include those based on Linear Quadratic Gaussian (LQG), Linear Quadratic Regulator (LQR), H-infinity ($H^\infty$), Proportional-Integral-Derivative (PID), and Neural Networks.

Some embodiments include a displacement sensor 560 that measures local actuator displacement. In such embodiments, the displacement sensor output is input to the controller to provide more refined actuator control.

For illustrative purposes we illustrate the performance enhancements attainable with these two stabilizer concepts. The ideal system can be normalized with J=1, $K_\infty$, and $(K_{\alpha\delta}-l_s^2k_s)=1$. For the case of an ideal system we can use a classical lag compensator design in the feedback loop $$G_c(s) = K\frac{s+5}{s+0.5}$$

and a simple proportional feedforward compensator, $G_f(s)=1$.

Figure 7:
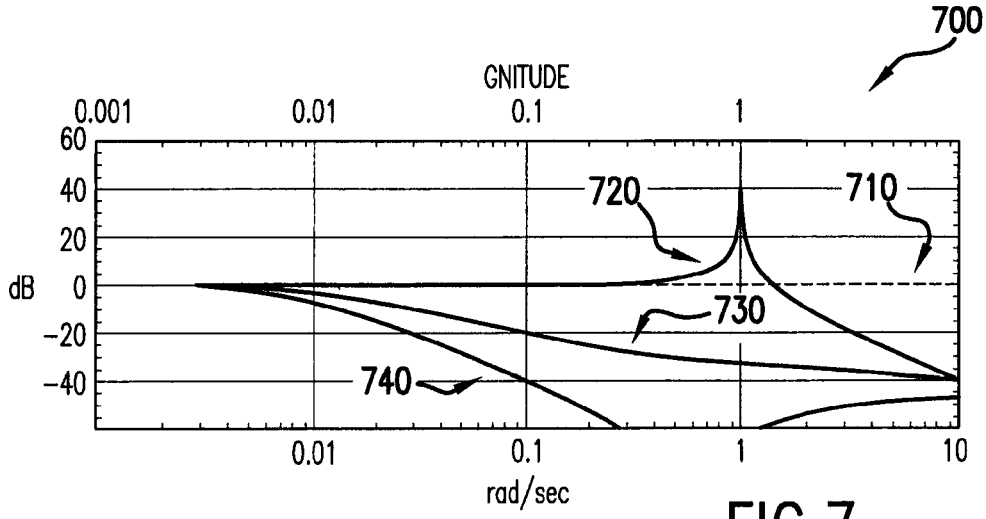
FIG. 7 is a plot showing relative performance of the controller configurations of FIGS. 5 and 6.

FIG. 7 illustrates a plot 700 of the normalized open and closed loop performance frequency responses for a normalized case. These response are defined as the gun barrel angular motion response to base (shooter) induced disturbance. For this application, the critical disturbance frequency range is approximately 1 Hz or 6.28 rad/sec. This includes typical respiration and heart rates. The rigid suspension line 710 represents a baseline corresponding to the barrel affixed to the base. Any base motion is transmitted directly to the barrel. The passive suspension curve 720 corresponds to a suspension with active control disabled, that is, a support spring only. The remaining two curves are active stabilization cases including the pure feedback configuration (730) and feedfoward/feedback sensor configuration (740). Note the improvement in performance that is achieved with the addition of feedforward when compared to the pure feedback case.

Figure 8A:
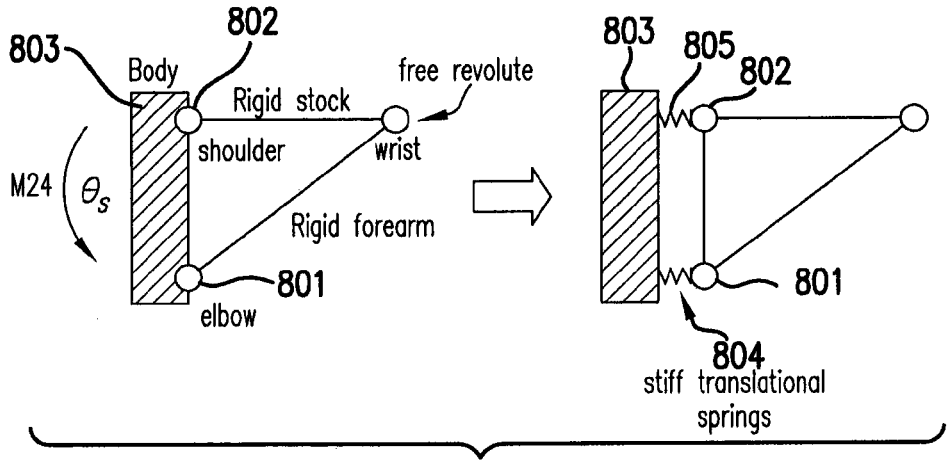
FIGS. 8*a* and 8*b* illustrates different models for a person holding M24 and M16 rifles, respectively.
Figure 8B:
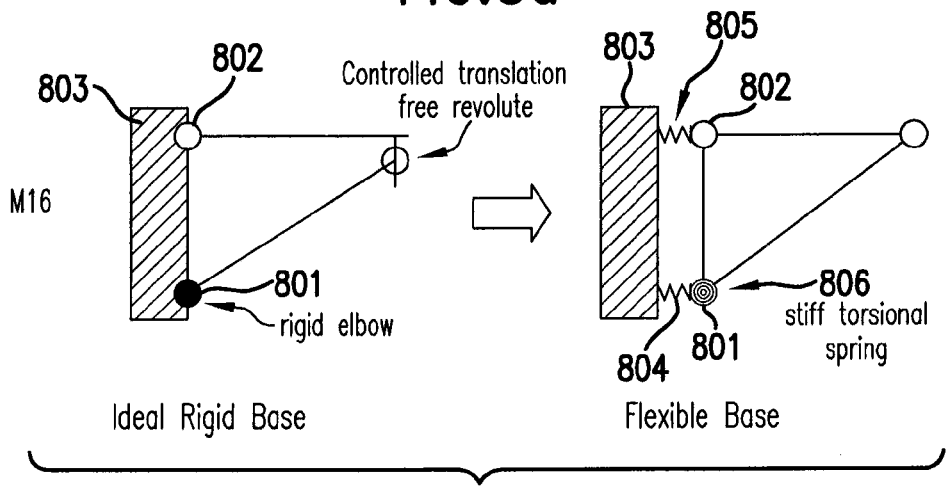

The weak assumption in the above analysis is that of an ideal rigid base, i.e., that the shooter's arm supporting the rifle is rigid. In fact, the arm is not rigid and in order to take into account this effect, we introduced additional degrees of freedom into the base model as illustrated in FIGS. 8*a* and *b*. These diagrams characterize the behavior in elevation of the rifle/base system for two different rifle types, the M24 (FIG. 8*a*) which is the currently fielded US Army sniper rifle and the M16 (FIG. 8*b*) which is the currently fielded US Army general purpose rifle. In FIG. 8*a*, the elbow 801 and shoulder 802 are connected to the body (base) 803 by stiff translational springs 804 and 805, respectively. In FIG. 8*b*, in addition to the connection of the elbow 801 and shoulder 802 to the base 803 by stiff translational springs 804, 805, the rigid elbow is replaced by a stiff torsional spring 806.

The goal of the addition of the additional degrees of freedom into the model is not to accurately model the base flexibility, but to establish a plausible family of qualitative models and to design a control system such that closed loop performance is insensitive to the entire family. Such an approach is necessary because the base parameters will vary, within a range, from individual to individual and also with physical condition and situation. Modern methods of robust control systems design are used to deal with formulations of this type. In particular, the control system designs employed in this inventions follow the methods described in S. Skogestadt and I. Postlethwaite, *Multivariable Feedback Control*. New York: J. Wiley and Sons, 1996, and H. G. Kwatny, "Lecture Notes on Robust Control," 2002, http://www.pages.drexel.edu/~hgk22/MEM633_635%20Folder/MEM633_635.htm, the contents of which are hereby incorporated herein by reference.

Actuator

The purpose of the actuator function is to generate a force and displacement in response to the controller command. The resulting force and motion is transferred to azimuth and elevation motions of the platform through the platform mechanism. A variety of motor technologies are available to provide this function as shown in Table 1 below. All the concepts discussed could use any of the actuators shown in Table 1 below; however, the best for a weapons application is the Shape Memory Alloy (SMA) wire. Therefore, exemplary actuators will be illustrated from the context of SMA, but it should be noted that any of the actuators discussed in this section could be used.

TABLE 1

Smart material technology comparison.

| Actuator System | Actuation Stress (MPa) | Actuation Strain (%) | Specific Work ($J/m^3$) | Energy aDensity (J/kg) | Driving Frequency (Hz) | Specific Power ($w/m^3$) |
|---|---|---|---|---|---|---|
| Conventional Technologies | | | | | | |
| Human Muscle | 0.4-0.5 MPa | 80-90% | 400-600 $kJ/m^3$ | 100-500 J/kg | 100 Hz | 1-5 $MW/m^3$ |
| Pneumatics | 0.8-1 MPa | 100% | 1 $MJ/m^3$ | 1-6 kJ/kg | 400-600 Hz | 10-50 $MW/m^3$ |
| Hydraulics | 70-80 MPa | 100% | 50-100 $MJ/m^3$ | 60-70 kJ/kg | 400-600 Hz | 1-5 $GW/m^3$ |
| Voice Coil Transducer | 0.05-0.06 MPa | 10% | 5-7 $kJ/m^3$ | 0.1-1 J/kg | 20-60 kHz | 10-50 $MW/m^3$ |
| Solenoid | 0.1 MPa | 40-50% | 50-70 $kJ/m^3$ | 10 J/kg | 80-100 Hz | 100-400 $kW/m^3$ |
| Smart Material Technologies | | | | | | |
| SMA | 800 MPa-50 GPa | 3-8%[14-16] | 10 $MJ/m^3$-1 $GJ/m^3$ | 7-9 kJ/kg | 1-15 Hz ~100 Hz (thin film) | 10-50 $MW/m^3$ |
| Ferromagnetic SMA | 40-50 MPa | 5-6%[13,17] | 2-5 $MJ/m^3$ | 300-500 J/kg | 10 kHz | 0.01-4 $GW/m^3$ |
| Magnetostriction | 200 Mpa-100 GPa | 0.1-0.2%[18] | 400 $kJ/m^3$-200 $GJ/m^3$ | 50-70 J/kg | 30 MHz | 1000 $GW/m^3$ |
| Electrostriction | 20 MPa-100 GPa | 0.1-0.5%[13] | 30 $kJ/m^3$-150 $MJ/m^3$ | 4-6 J/kg | 100 kHz | 100-300 $MW/m^3$ |
| Low Strain Piezoceramic | 3 MPa-50 GPa | 0.002-0.003% | 100 $kJ/m^3$-100 $MJ/m^3$ | 0.01-0.04 J/kg-kJ/kg | 30 MHz | 100-500 $MW/m^3$ |
| High Strain Piezoceramic | 8 MPa-100 GPa | 0.1-0.2% | 30 $kJ/m^3$-100 $MJ/m^3$ | 4-7 J/kg-kJ/kg | 20 MHz | 10-80 $GW/m^3$ |
| Single Crystal Piezoelectric | 30-50 GPa | .16-.4% | 7-18 $KJ/m^3$ | 1-2.3 J/kg | 10-20 MHz | 10 $MW/m^3$ |
| Piezopolymer | 2-2.5 MPa-1 GPa | 0.1-0.2% | 10 $J/m^3$-1 $MJ/m^3$ | 1-4 J/kg | 10 MHz | 1-5 $GW/m^3$ |
| Acrylic Electroactive Polymer | 7.2 MPa | 215% | 3.4 $MJ/m^3$ | 3.4 kJ/kg | na | na |
| Silcone (CF19-2186) Electroactive Polymer | 3.0 MPa | 63% | 0.75 $MJ/m^3$ | 0.75 kJ/kg | na | na |
| Shape Memory Polymer | 4 MPa | 100% | 2 $MJ/m^3$ | 2 kJ/kg | na | na |
| Electrochemo-mechanical conducting polymer (Polyaniline) | 450 MPa | 10% | 23 $MJ/m^3$ | 23 kJ/kg | na | na |
| Mechano-chemical Polymer/Gels (polyelectrolyte) | 0.3 MPa | >40% | 0.06 $MJ/m^3$ | 0.06 kJ/kg | na | na |

Most conventional technologies—electrical, hydraulic, and pneumatic—all have difficulty meeting the high energy density and specific power needs of a self-contained handgrip stabilizer. The few that can meet the requirements suffer from power problems. For example, a top commercial solenoid (Detroit Coil Model 28-460) that would meet the performance specifications of a weapons application draws current constantly at levels that would drain a battery in approximately 15 minutes. In comparison, most smart material actuators should have approximately 6 to 80 hours of battery life—reasonable for a fielded weapon.

Unfortunately the high performance specification coupled with the extreme constraints and hostile environment limit the viable smart materials. In an initial attempt, piezoelectric actuators with regenerative electronics were developed for a 1 DOF platform [1,2]. These piezoelectric actuators were semi-successful. They demonstrated the necessary performance of ±400 microns resulting in a point-of-aim displacement of ±1.5 m at 400 m range. The regenerative electronics increased the battery life (a standard 9V) from ~1000 to ~8000 shots under a 2 sec/shot assumption. While many valuable lessons were learned from this experience, these actuators tend to be a little large (22×28×128 mm), heavier (500 g), more costly, and less robust than other options such as SMA.

Fortunately, SMA is a viable alternative. When compared to other smart materials, SMA is unmatched on specific power (>100 kW/kg) and specific work (up to GJ/m3—with the exception of magnetostrictive materials). It simultaneously produces high strains (3-8%) and high stresses (up to 50 GPa). In addition, it is extremely rugged unlike magnetostrictive, electrostrictive, and piezoelectrics (ceramic and single crystal) which are all brittle and break easily. SMA is resistive to the environment, commonly being sought for implantations within the hostile human body. It is also the most inexpensive of the smart materials costing only cents to a few dollars in comparison to hundreds or thousands of dollars for piezoelectric, electrostrictive and magnetostrictive actuators.

Figure 9A:
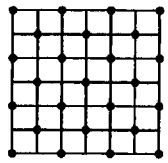
FIGS. 9*a*, 9*b*, 9*c* illustrate different molecular structures for a shape memory alloy wire used as an actuator according to an embodiment of the invention.
Figure 9B:
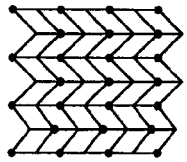
Figure 9C:
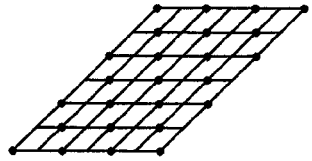

Shape memory alloys are metals capable of undergoing a particular solid state phase change, classified as first-order diffusionless displacive transformations. In most SMAs, a temperature change initiates this phase change, causing the molecules to rearrange structure between Martensite and Austenite. Heating the SMA causes the microstructure to arrange itself into Austenite, which is of cubic form (FIG. 9*a*). Upon cooling, however, the microstructure changes state to Twinned Martensite (FIG. 9*b*), which is different in structure but identical in size and shape as the cubic Austenite phase. Mechanically deforming the Twinned Martensite causes the microstructure to align into Detwinned or Deformed Martensite (FIG. 9*c*), which retains the deformation until the SMA is heated back to Austenite. [16] Because the force required to deform Twinned Martensite is less than the force generated by the SMA when changing from Deformed Martensite to Austenite, an actuator may be created by cycling through the phases and applying, for example, a reset spring that deforms the Twinned Martensite.

Figure 10:
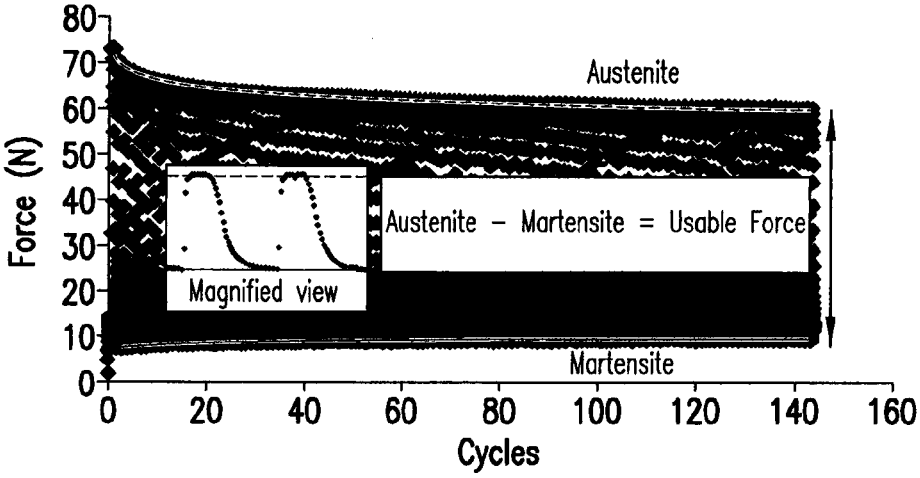
FIG. 10 is a plot of force as a function of a number of cycles for a typical shape memory alloy wire.
Figure 11:
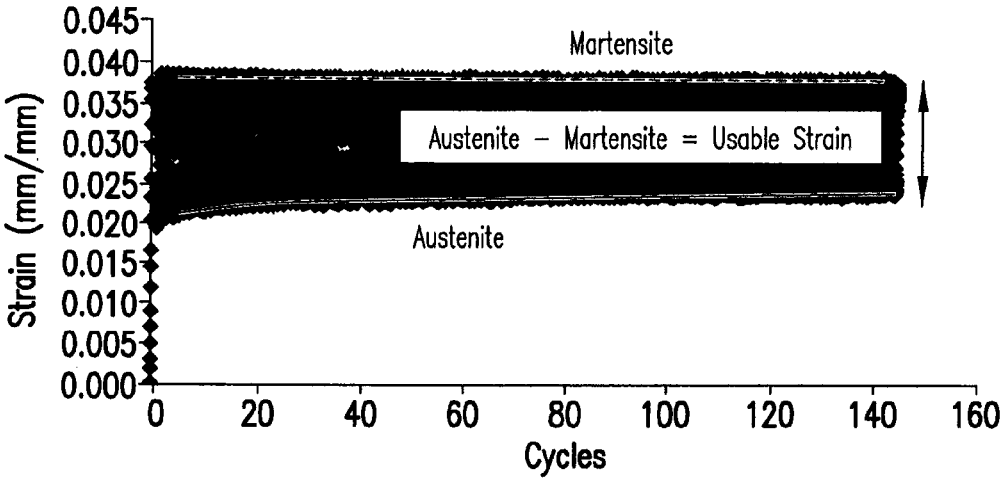
FIG. 11 is a plot of strain as a function of a number of cycles for a typical shape memory alloy wire.

FIGS. 10 and 11 depict examples of typical force and strain results for a SMA wire in a simple actuator, in this case with an equivalent 28.2 kN/m reset spring. Both graphs show the initial zero position of the austenite free length and the stretching of the wire by the spring to 4% strain in the martensite phase, requiring 9.88 N. When the wire is heated, it contracts, in this case to 2.04% relative to the austenite free length. The magnitude of total strain when heated is dependent upon the resisting spring, which applies 70 N of force in this case. As the wire is cycled it initially degrades significantly (13% in strain, 14% o in force), but tapers off quickly (~40 cycles) to nearly a steady state, in this case 2.4% strain and 60 N. This degradation is commonly referred to as creep. The difference between the steady-state values is the amount of "usable" strain or force available to change states in a system between the "hot" austenite and "cool" martensite phases.

The creep shown in FIGS. 10 and 11 represents an inconsistency in actuator behavior, and is undesirable in most designs. To solve this problem, a procedure to condition the wire to insignificant creep levels was developed. This procedure was based upon a Boeing research study [18] of several factors (loads, load path, cycle, etc.) affecting creep. Boeing determined that very low creep rates were observed if the stress was decreased after high stress cycling. Using this conclusion, an in-situ conditioning regime was created to reduce creep to insignificant operational levels.

The process begins by applying 1.5 times the operation force to the SMA actuator. However, the maximum load must not surpass the yield stress of austenite. In this case, the wire was selected to operate around 35 to 40 KSI and conditioned below 70 KSI. The system must then be cycled by heating and cooling the SMA. For example, an electric current (1.75 A for 15 mil 70° C. wire) may be used to resistively heat the wires and convection in room temperature air may be used to cool (representing one cycle). Many cycles are applied to the actuator at the higher stress level to condition it. Once conditioned the actuator and system is reset and ready for operation.

Figure 12:
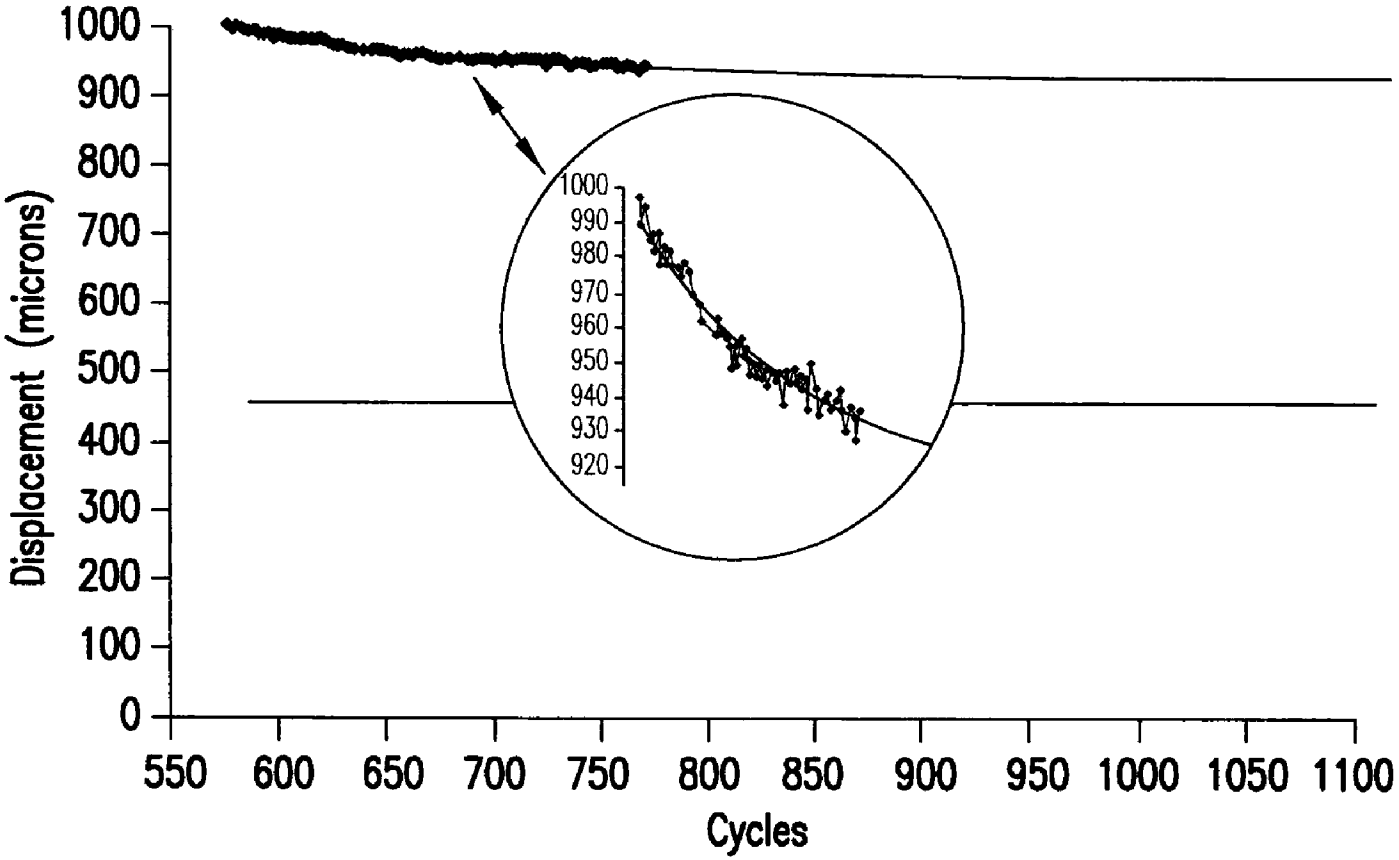
FIG. 12 is a plot showing typical results from the conditioning of a 15 mil Flexinol 55 shape memory alloy wire actuator with austenite final transition temperature at 70 degrees Celsius.

FIG. 12 shows typical results from the conditioning a 15 mil Flexinol 55 wire actuator with austenite final transition temperature at 70° C. While creep on the order of 6 to 8% is observed in the first 700 cycles, convergence does emerge at a lower displacement. If the weights are removed and the system reset at this stage, the actuator will not show significant creep. For example, after only 1100-1200 cycles, the actuator will not creep more than 0.5% from its post-conditioned displacement.

SMA may come in several forms such as coils, ribbons, and wires. However, to obtain a proper amount of displacement, large lengths of SMA are required and packaging becomes an issue. Consequently, the most feasible choice in SMA form is wire because it is relatively simple to package (wrapping is an option), and because it imparts the one-dimensional actuation required by the stabilizing handgrip.

Power Supply

Power is a major concern with any hand-held device which must be battery powered. To give an idea of the feasibility of a hand-held battery powered stabilization platform in terms of battery size and life, an example case was examined: the stabilization of an M24 sniper rifle. Power consumption for commercial-off-the-shelf batteries was estimated based upon a prototype L-Lever INSTAR demonstration platform [1]. Power was calculated using the power draw to hold the maximum displacement, 2.19 Watts at 1.18 A and 1.86V. This is an overestimate of the actual power consumption since the actuator will be cycling with less of a draw at lower displacements; thus, the battery life and number of shots is a conservative estimate. If instead a simple sinusoidal RMS duty cycle is assumed then the average power consumption will be 40.5% of the power at maximum displacement. In either case, the battery life is determined simply based upon their Watt-Hr rating. Table 2 gives a summary of the power analysis for a variety of batteries comparing battery life, mass, total shots along with shots per dollar and shots per gram assuming 2 seconds per shot. All batteries are standardized to provide 9 V for comparison purposes. The overall life of the battery ranged from 6 hours to over 79 hours of continuous operation: a very reasonable battery life. With this comparison the number of shots ranges from ten thousand to over 140 thousand. This is significant improvement over previous work, where, for example, even using regenerative electronics with the piezoelectric actuator, only 8000 shots were possible under the 2 second shot assumption.

TABLE 2

Power analysis tradeoff for various batteries [19].

| Type | Adj to 9 V | (mAhr) | Life (hrs) | Mass (g) | Shots (2 sec/shot) | Cost | Shots per $ | Shots per |
|---|---|---|---|---|---|---|---|---|
| Alkaline 9 V | 1 | 570 | 6 | 45 | 10,404 | $ 0.96 | 10,838 | 231 |
| NiCad-AA 1.2 V | 7.5 | 1,000 | 11 | 172 | 18,270 | $10.44 | 1,750 | 106 |
| Ni-MH-AA 1.2 V | 7.5 | 1,550 | 16 | 195 | 28,314 | $13.25 | 2,136 | 145 |
| Lithium-A 3 V | 3 | 2,200 | 23 | 40 | 40,176 | $18.68 | 2,150 | 992 |

TABLE 2-continued

Power analysis tradeoff for various batteries [19].

| Type | Adj to 9 V | (mAhr) | Life (hrs) | Mass (g) | Shots (2 sec/shot) | Cost | Shots per $ | Shots per |
|---|---|---|---|---|---|---|---|---|
| Alkaline AA 1.5 V | 6 | 2,870 | 30 | 144 | 52,416 | $1.50 | 34,944 | 364 |
| Alkaline C 1.5 V | 6 | 7,800 | 80 | 420 | 142,452 | $3.33 | 42,735 | 339 |

The optimal battery selection depends on the driving constraints of cost or weight. In combat situations where the weight a soldier carries is at a premium, the lithium A battery would be best suited because it provides 992 shots per gram. If cost is the limiting factor then alkaline batteries provide the most shots per dollar, 42,000.

Although batteries are the preferred power source, it should be noted that many other battery and other power technologies could work in this device, and the selections here are shown as examples only and should not be understood to limit the invention.

Platform Mechanism and Weapon and Handgrip Interfaces

Figure 13:
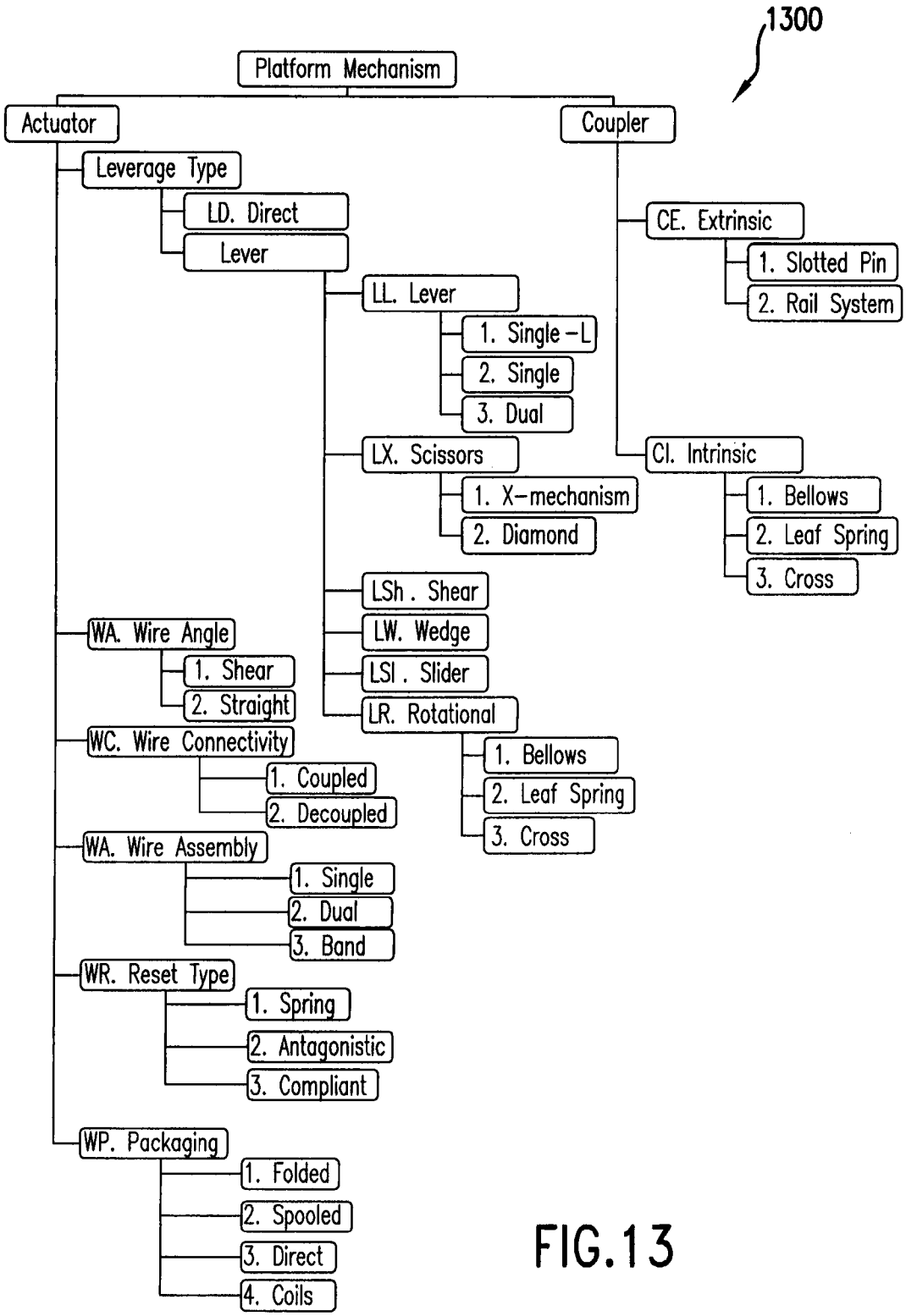
FIG. 13 is a tree diagram illustrating various platform mechanism configurations.

The platform mechanism and the weapon and handgrip interfaces transfer force and motion from the actuators to the weapon relative to the handgrip. To classify possible designs, the functions are broken down into two key elements: 1) actuation architecture that determines how the smart material (SMA wire) motion is converted to the development of the platform motion, and 2) the coupling between the two degrees of freedom within the platform mechanism, and 3) the interfaces between the platform mechanism and both the handgrip and weapon. The categorization of the concepts for each of these is depicted in a concept tree 1300 shown FIG. 13. The two main functions: actuator, and coupler, are expanded into their own trees. Links to specific concepts within each tree are presented in the appendix.

Many choices exist for how SMA wire can be used to generate a particular motion. The various design degrees of freedom and the relative advantages and disadvantages within each are discussed. The discussion here is not specific to a particular degree of freedom—any actuator concept could work for either degree of freedom, although some are better suited to one or the other particularly due to packaging constraints.

The preferred embodiment of the actuators utilized in this invention is Nitinol SMA actuator in a wire form factor. The Nitinol wire material may be composed of either the type 55 or type 60 and is preferably preconditioned as described herein and is preferably preconditioned as described herein either prior to attachment or after mounting in the device.

Wire Assembly

When designing SMA wire actuators, the required force determines the required cross-sectional area of SMA actuators. This cross sectional area, however, can be distributed in different ways. The simplest is a single thick wire with the required area. This has the advantage of simple, robust attachment, but the thicker wire is slow to cool, reducing cycle frequency. The single wire can be split to two wires in parallel, significantly improving cooling with a slightly more difficult attachment. The extreme case is a band of many very thin wires, which will cool quickly due to the high surface area to volume ratio, but will be more difficult and less robust to attach.

Wire Angle

While a SMA wire is fundamentally a tensile actuator, the direction of motion generated does not necessarily need to be along the axis of the wire. A straight pull is generally simple and works well in mechanisms with all components in line, which may be advantageous to fitting within a long, narrow package where the desired motion is along the long axis (i.e. elevation within a vertical handgrip). Alternatively, the SMA wire can pull at an angle to some shearing mechanism which constrains the motion in a different direction. This has two advantages: it allows for a built-in mechanical advantage, reducing force, and it allows for an adjustment of the package dimensions in cases where the desired motion (i.e. azimuth) is not along the long axis of a long narrow package.

Wire Reset

Not only is SMA wire limited to pulling in one direction, but it requires a reset force to stretch it back to its initial length once it has cooled after actuating. Three main options exist for generating this force: a return spring, a compliant mechanism, and a second, antagonistic wire. A return spring is generally simple to design, adjust, and control, but has the property that when powered off, the mechanism moves to one end of its range of motion. This is a definite power disadvantage for cyclic actuators; the neutral position is in the half-actuated state, so even when the control is not particularly active, a significant amount of power must be applied. Also, since the return spring must not only be strong enough to reset the SMA, but also to provide actuation in one direction, the SMA wire must be strong enough both to overcome the spring as well as meet the actuation specification. A compliant mechanism uses deformations within the structure of the mechanism itself to act as a return spring. This has similar properties to a return spring, but while it uses fewer parts and is simpler to manufacture, it is more difficult to design and adjust. Using a second wire acting in the opposite direction along the same degree of freedom to reset the wire creates an antagonistic pair of wires which work together to create both directions of motion. The main advantage of an antagonistic pair is that the power used is related to the amount of control action taken, and maintaining the nominal position uses no power. A secondary advantage is that the cyclic actuation speed can be increased somewhat since after one wire actuates, motion can be generated in the opposite direction by the antagonistic wire before and while the first wire cools. Also, since the cool wire is much less stiff than the heated wire and provides a resistive force only a fraction of the required actuation force, thinner wires may be used than in a spring-return design. The cost of these advantages is in the increased complexity in control to overcome interactions between hysteresis loops in the two sets of wires.

Wire Connectivity

An SMA wire generates motion between the two endpoints ("ground" and "output") to which it connects. In a two degree of freedom mechanism, the relative connection between the two sets of wires determines the degree to which the motions of the two degrees of freedom are coupled. While there is no specific rule which tests for the coupled connectivity between two sets of wires, in general, if either the grounds or the outputs of both sets of wires are connected to the same rigid body, the motion of one set of wires will affect the motion of the second set. If the ends of both sets are connected to different rigid bodies, or if the ground of one set is attached to the output of the other, the motions will generally be independent. The structure of the mechanism itself can also cause coupling between the wire motions if the motion of one rigid body is coupled to the motion of another. A system with coupled wire motions tends to be more difficult to control than a decoupled system since both degrees of freedom must be taken into account in the motion. However, coupled designs will typically contain fewer components with fewer connections between them and be easier to construct.

Wire Packaging

To fit the SMA wires within the dimensions of the entire handgrip may or may not be difficult. The simplest case is where the required length of the wires is less than the handgrip's longest dimension, in which case, the wires can be laid out directly in a straight line. For longer wires, there are several options for fitting them inside the handgrip. Folding the wires involves passing the wire over a fixed pulley or shaft to double (or triple or more) the wire over itself. This reduces the package length with only a slight increase in mechanical complexity, although there may be significant friction losses in the folds. Also, some additional volume is necessary since the pulley must be of a large enough diameter not to over stress the folded wire in bending. If a very compact design is required, the wire can be spooled onto a fixed pulley, where the wire winds and unwinds slightly as it actuates, and only the tail(s) of the wire extend off the pulley. While the longest dimension of a spooled design may be very short, the overall volume could be large since the entire spool must fit inside the handgrip. Also, such a design may experience significant friction losses since the contracting wire must slide on the entire surface of the spool. Another approach to reducing package length of a wire is to form a coil (like a spring). In this case, even a very short coil contracts along its axis with very large deflections, at the expense of a much larger overall volume for the entire coil, and a reduced force capability. The appropriate packaging methodology depends on the dimensions of the handgrip and the layout of the mechanism, power, control, and other components. In the following passages, direct packaging is assumed, but could be replaced by other packaging methods to fit within the handgrip.

Leveraging

The dimensions of a wire determine its performance, in particular, the diameter determines both the force and (inversely) the cooling speed, and the length affects the generated motion. A direct (unleveraged) mechanism, where the wire attaches directly to the motion platform, generating the same motion, tends to be simpler in terms of number of parts, but allows no way to adjust the displacement required by the actuator. Within a given package size, however, leverage can be used to trade off force for displacement and modify the requirements on a wire. For example, if a thin wire is required for fast cooling, the displacement can be leveraged to reduce the force requirement at the cost of a longer wire. A leveraged mechanism tends to require additional complexity in the leveraging itself but allows additional flexibility in the design of the actuators. Many concepts for leveraging mechanisms are detailed in the appendix.

Coupler

In a two degree of freedom platform mechanism, some form of coupling is required to bring the two degrees of freedom together from the two actuators. The function of the coupler depends on the connectivity between the two degrees of freedom, and great design freedom exists in the structure of the coupler.

Coupler Connectivity: Parallel vs. Series

Figure 14C:
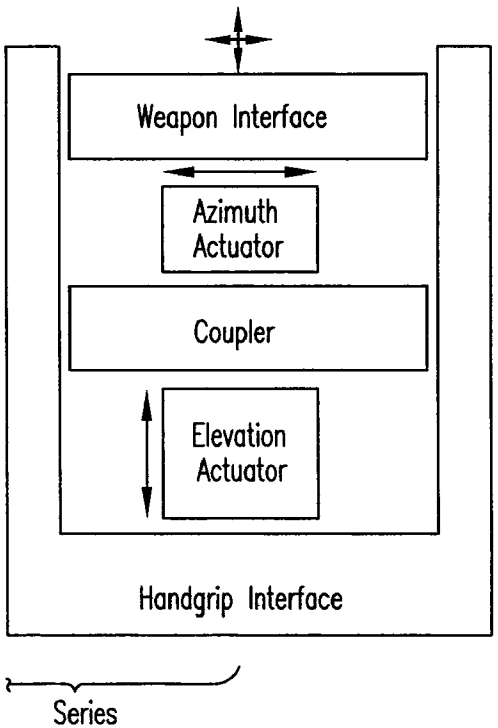
FIGS. 14*a*, 14*b* and 14*c* are conceptual block diagrams showing various possible platform mechanism arrangements.
Figure 14B:
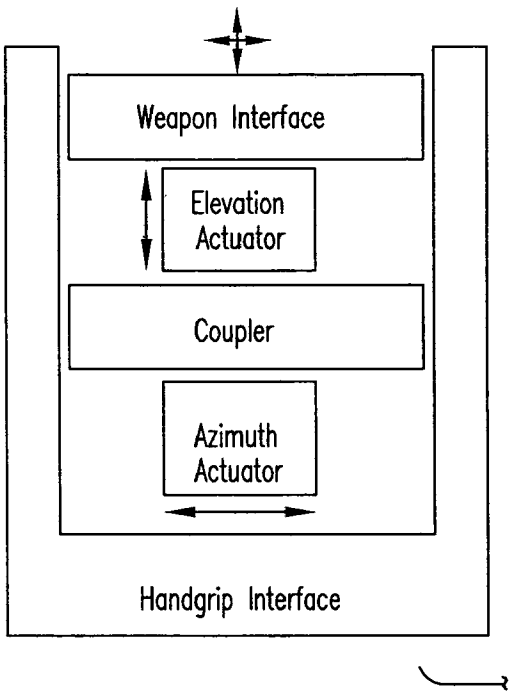
Figure 14A:
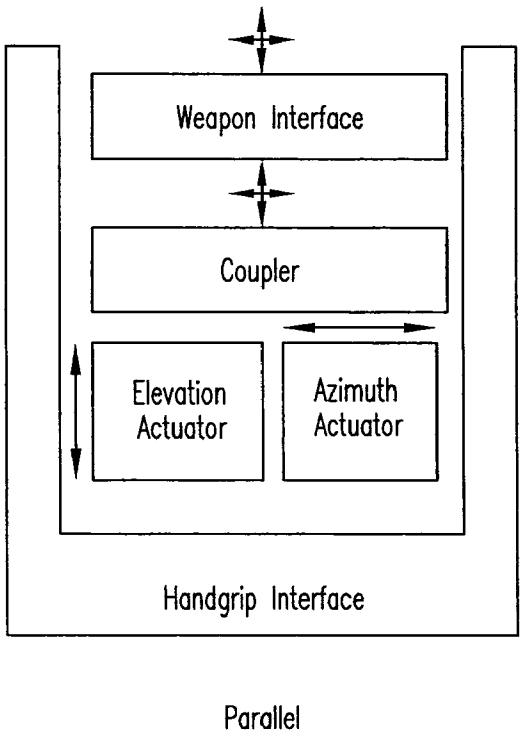

Two fundamental architectures exist for bringing the two motions together: parallel and series as shown in FIG. 14. In a parallel architecture, the azimuth and elevation motions are each generated relative to the same reference (the handgrip interface) and applied together to the weapon interface at the same point through the coupler. The coupler must combine the two motions without them interfering, and also constrain the platform from moving in other directions. In a series architecture, one motion is generated relative to the handgrip on a one degree of freedom sub-platform, and the second motion is generated relative to the sub-platform. A design choice must be made as to what order the motions are generated (see the right side of FIG. 14), depending on factors such as mechanism complexity and packaging. In the series case the sub-platform is the coupler and has a much simpler function than the coupler in the parallel case. While neither architecture has clear advantage over the other, the complexity of each arises in different portions of the design. In a parallel mechanism, the complexity tends to lie in the coupler itself, where generating the motion for each degree of freedom is straightforward. In a series mechanism, the complexity tends to lie in the development of the second degree of freedom since it must be constrained to move relative to the moving sub-platform. Example designs are given in the appendix.

Coupler Structure: Extrinsic vs. Intrinsic

Two main categories of couplers exist according to their structure: extrinsic and intrinsic. With an extrinsic coupler, two completely independent motions are coupled by a separate mechanism which must enforce the constraints and combine the motions. An intrinsic coupler uses the structure of the motion-generating mechanism itself to constrain and combine the motions. Again, neither architecture has a clear advantage over the other, but the complexity is shifted. Extrinsic couplers have the capability of completely decoupling the motions, simplifying control, but generally add parts and complexity. Intrinsic couplers use the existing parts, so tend to be simpler in construction, but often generate motions that are either coupled or not exactly rectilinear, and therefore introduce control complexity.

Handgrip and Weapons Interfaces

When attaching device components to both the handgrip and weapon, interfaces are required which allow certain motions while constraining other motions. The interface can be classified according to how the platform (or sub-platform) is joined to the base structure (the handgrip or weapon). Three categories exist for the constrained connection between two mechanical elements: revolute joint (rotation), prismatic joint (translation), and screw joint (rotation plus translation along the axis of rotation). The motion constraint may be different for each degree of freedom and for each interface. In many cases interfaces are required not only at the base and output of the mechanism, but to enforce constraints of various components within the mechanism, particularly in the case of extrinsic couplers.

DETAILED EXAMPLES OF PLATFORM MECHANISMS

Four example platform mechanisms are set forth below. These examples represent three main categories: parallel architecture with external coupling, parallel architecture with intrinsic coupling, and series architecture with intrinsic coupling. Other concepts listed in the appendix may be developed similarly to those outlined in the examples below.

Example 1

Direct Platform

Figure 15:
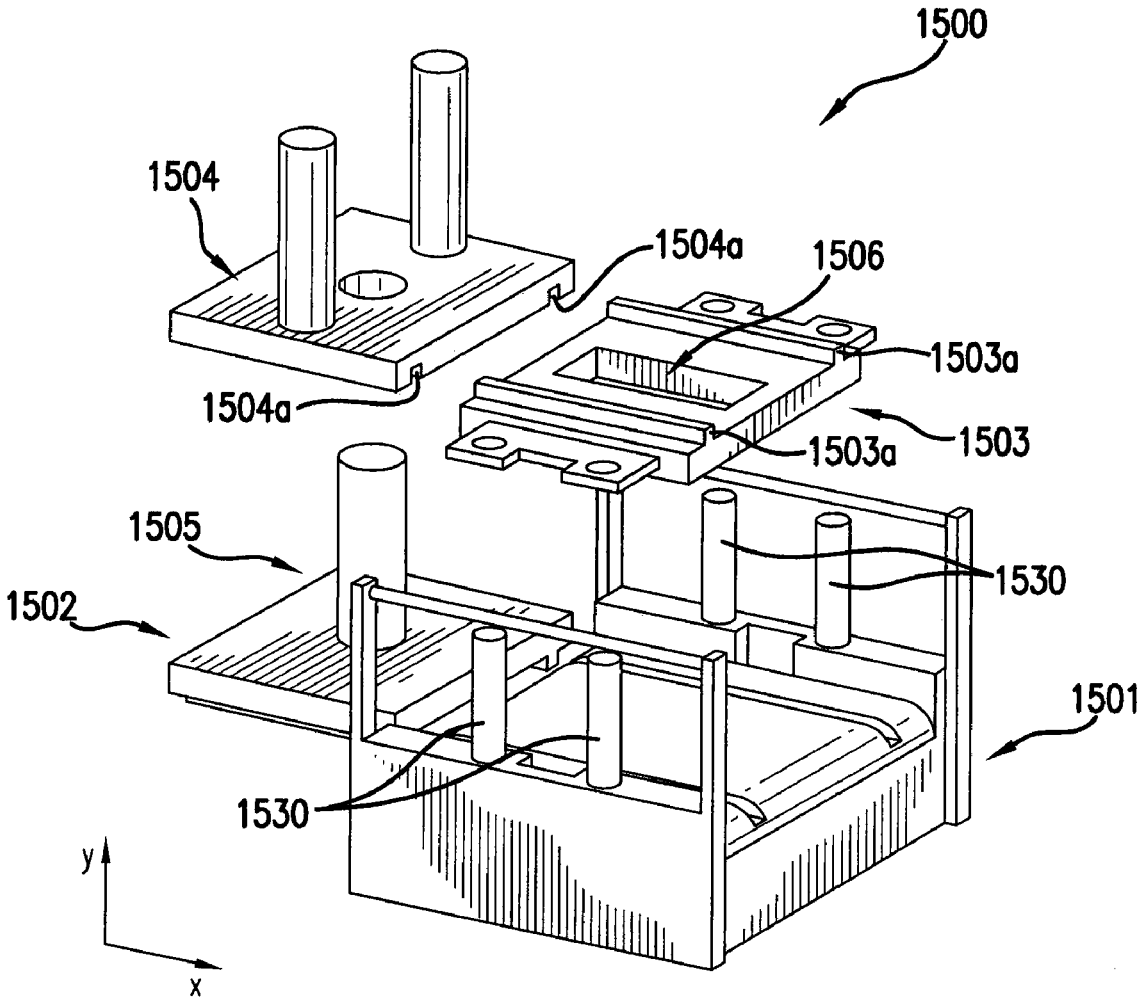
FIG. 15 is an exploded perspective view of a direct platform mechanism according to an embodiment of the invention.

A direct platform mechanism 1500 is illustrated in FIG. 15. The direct platform mechanism 1500 consists of SMA wires working with direct (1:1) leverage to create elevation and azimuth motions. From the concept tree (FIG. 13) this design, in addition to the direct leverage type, consists of straight wire angle, decoupled wire connectivity, single wire assembly, antagonistic reset type, direct wire packaging, and an extrinsic slotted pin coupler. The platform mechanism 1500 includes a parallel coupling mechanism (Appx. CE.1), which consists of a base 1501 that is fixed to the handgrip 100, an azimuth actuator 1502 that moves only in the x direction, a middle vertically actuating plate 1503 moving in the y direction, and a top plate 1504 that connects to the rail adaptor (not shown in FIG. 15). The azimuth actuator 1502 imparts a decoupled motion to the top plate 1504 via a pin 1505 that passes through a slot 1506 in the middle plate 1503. The vertical actuator plate 1503 is free to slide relative to the top plate 1504 in the azimuth direction, but is fixed vertically by a rail system comprising rails 1503*a* formed in the vertical actuator plate 1503 and corresponding slots 1504*a* formed in the top plate 1504.

Figure 16A:
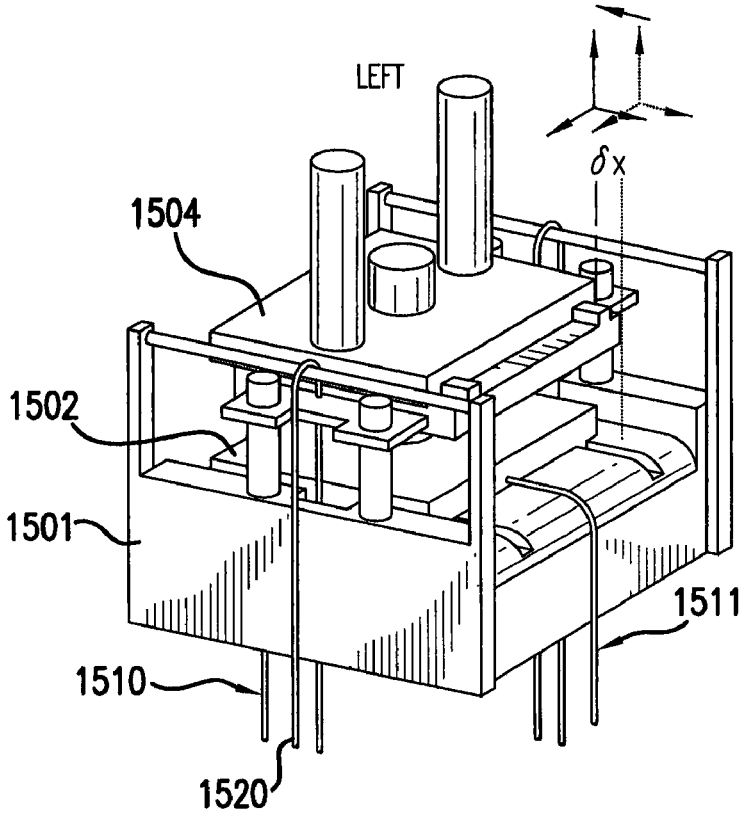
FIGS. 16*a* and 16*b* are perspective views of the direct platform mechanism of FIG. 15 activated to the left and right, respectively.

Referring now to FIGS. 16*a* and *b*, two SMA wires 1510, 1511 are attached to the left and right sides, respectively, of the azimuth actuator 1502 via a set screw, or a crimp provided by the SMA manufacturer. Similarly, two wires 1520 are attached to the top of the vertical actuator plate 1503 and two wires 1521 are attached to the bottom of the vertical actuator plate 1502. The pins 1530 that the vertical actuator slides on may be replaced with machined slots.

Figure 16B:
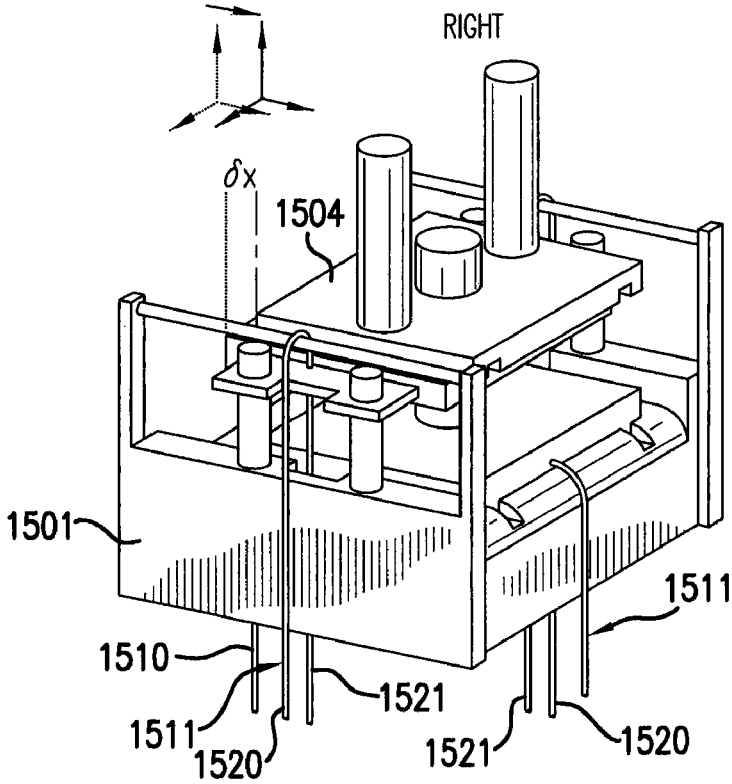
Figure 17A:
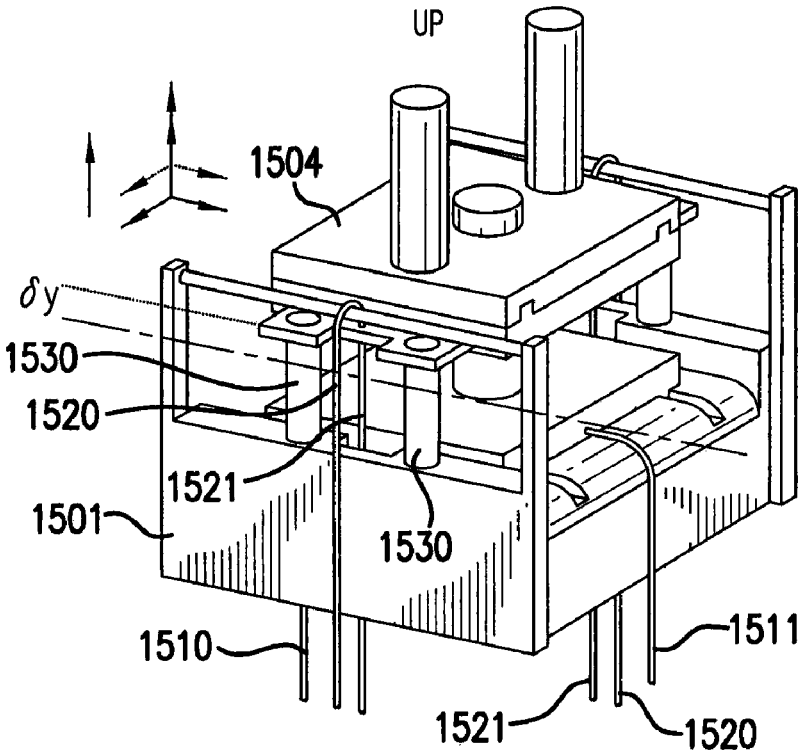
FIGS. 17*a* and 17*b* are perspective views of the direct platform mechanism of FIG. 15 activated up and down, respectively.
Figure 17B:
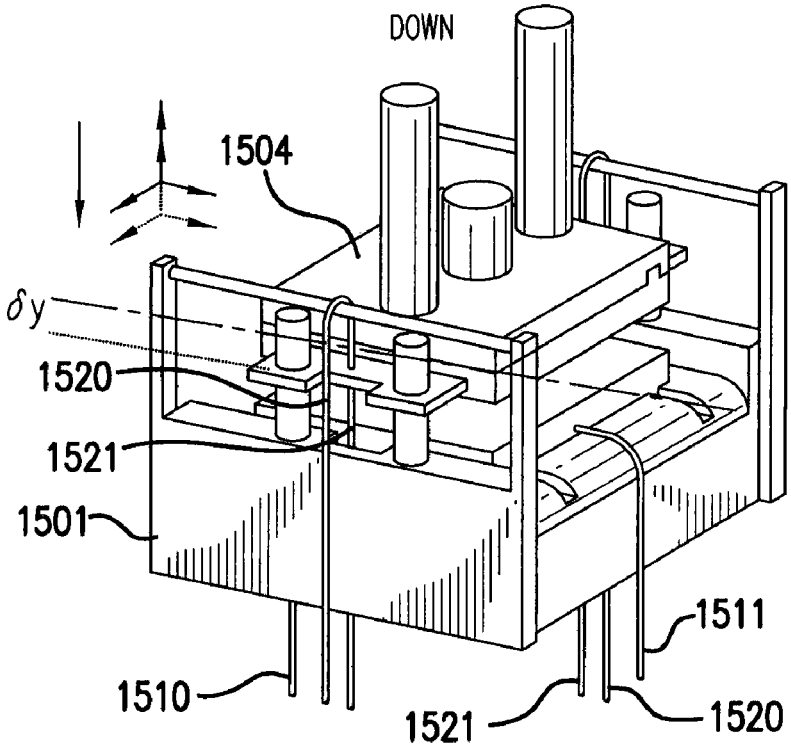

The operation of the Direct Platform mechanism 1500 occurs when SMA wires 1510, 1511, 1520, 1521 are attached to the azimuth and vertical actuator plates 1502, 1503 and anchored to the bottom of the handgrip (or wrapped around an anchored loop and fixed to some other stationary point in the handgrip). The SMA wires are heated (e.g., by running a current through the SMA wires or exposing them to magnetism) or cooled (e.g., through the use of thermoelectric coolers, heat sinks, cooling sleeves, small wire cross sections, forced convection or conductive cooling) depending on the required actuation type. For instance, if the device were to be actuated to the left as shown in FIG. 16*a*, the SMA wire 1510 on the left hand side of the azimuth actuator platform 1502 is heated, causing the wire 1510 to contract and force the platform 1502 leftward. To move the platform 1502 to the right as shown in FIG. 16*b*, the SMA wire 1511 connected to the right side of the platform 1502 is heated and the rest of the wires are kept cool. Likewise, to move the platform up as shown in FIG. 17*a*, the SMA wires 1520 connecting to the top of the elevation actuator platform 1503 are heated, causing them to contract and force the elevation actuator platform 1504 up. To move the platform 1504 down as shown in FIG. 17*b*, the bottom wires 1521 are heated while the rest of the wires remain cool. If a mechanical advantage were needed, an azimuth elevation lever (Appx A.) could readily be attached to the azimuth or elevation actuator platforms 1502, 1503. Thus, the direct method design may be altered to include a leverage mechanism.

The direct platform mechanism 1500 is simple and compact. The coupling mechanism may be manufactured to fit into a small volume, leaving room for other components in the handgrip. This advantage also translates directly to weight reduction. Since the wires travel along the periphery of the interior volume, additional components such as a battery, sensors, and a controller can easily be incorporated into the middle handgrip volume. An additional benefit of the direct platform mechanism 1500 is that it facilitates control by decoupling the elevation and azimuth motions. A position consisting of both elevation and azimuth is easily achieved by actuating both and azimuth and vertical actuator plates 1502, 1503. However, this design does involve the manufacturing of small components. In addition, since there is no leverage present, long SMA wires are necessary to generate appropriate motions. However, some of these challenges can be solved through design. For example, the pins 1530 that the vertical actuator platform 1503 travels on may be replaced with a slider that is easier to produce, and long wires may be packaged by folding once along the length of the handgrip as described above.

Example 2

Bellows

Figure 18:
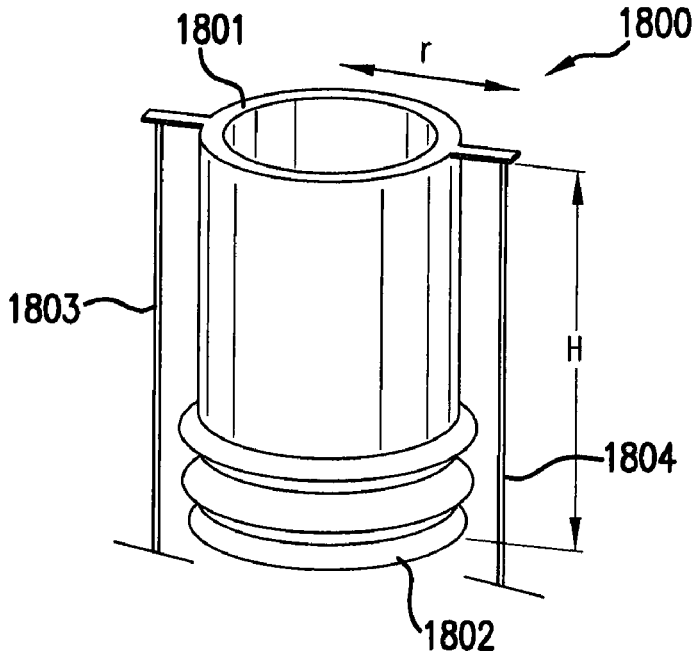
FIG. 18 is a perspective view of a bellows platform mechanism according to an embodiment of the invention.

The Bellows platform mechanism 1800 illustrated in FIG. 18 differs from the direct platform mechanism in that it possesses an intrinsic coupler, eliminating the need for an external coupling mechanism. This parallel type actuator comprises a hollow cylinder 1801 with bellows 1802 built into the base that provides both vertical and rotational stiffness. SMA wires 1803, 1804 anchored to a ground point are attached to the left and right sides, respectively, of the top of the cylinder 1801. While there is no leverage in the vertical direction, there is a mechanical advantage directly proportional to the ratio r/H of the cylinder radius r to the cylinder height H for actuation in the azimuth direction. The bellows mechanism 1800, from the concept tree (FIG. 13), consists of a rotational bellows leverage type, straight wire angle, coupled wire connectivity, single wire assembly, spring reset type for elevation, antagonistic reset type for rotation, direct wire packaging, and an intrinsic coupler.

Figure 19A:
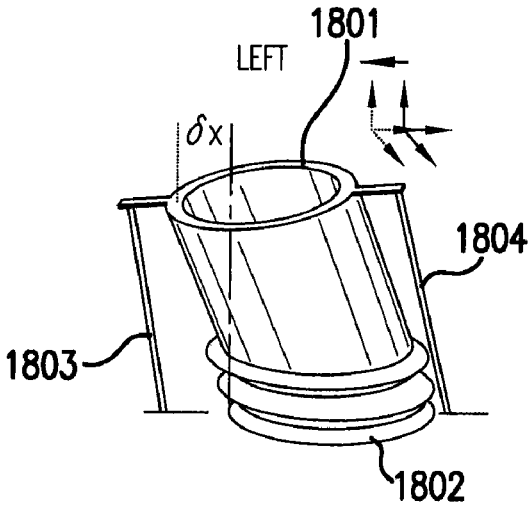
FIGS. 19*a* and 19*b* are perspective views of the bellows platform mechanism of FIG. 18 activated to the left and right, respectively.
Figure 19B:
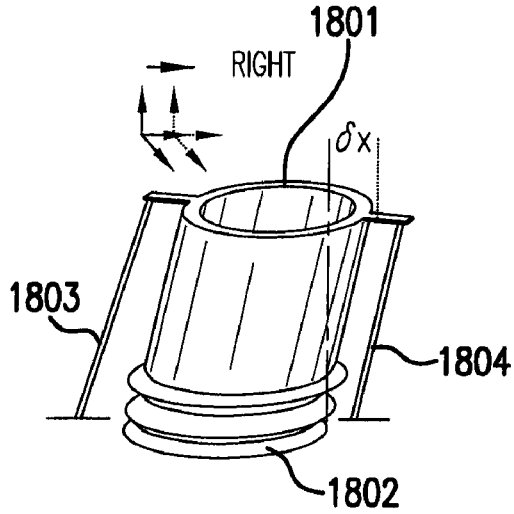
Figure 20A:
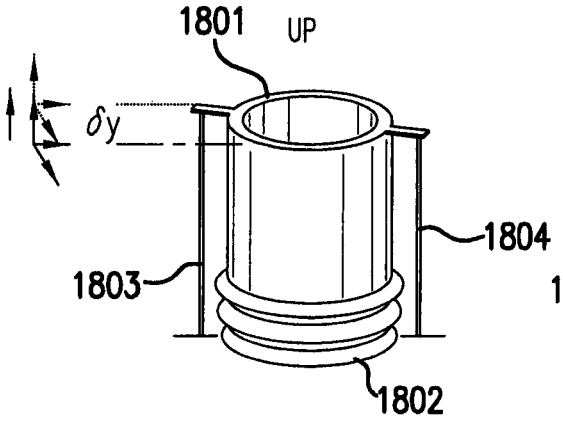
FIGS. 20*a* and 20*b* are perspective views of the bellows platform mechanism of FIG. 18 activated up and down, respectively.
Figure 20B:
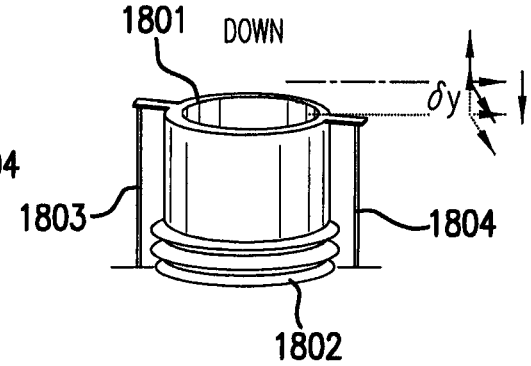

Moving the platform 1800 in the azimuth direction is done by heating only one SMA wire, causing it to contract and rotate the cylinder about its base, tipping it sideways. Because only a small motion in the azimuth direction is required, this rotation approximates a linear translation. Specifically, to move the platform 1800 to the left, the left SMA wire 1803 is heated, forcing it to contract and rotate the cylinder 1801 in an anti-clockwise direction, producing leftward motion as shown in FIG. 19*a*. Heating the right SMA wire 1804 and allowing the left wire 1803 to cool produces the opposite effect as shown in FIG. 19*b*. Moving the bellows actuator 1800 in the vertical direction (elevation), requires both of the SMA wires 1803, 1804 to be heated or cooled simultaneously. For example, to lower the mechanism 1800, both of the SMA wires 1803, 1804 are heated causing them to contract. This forces the bellows to compress as shown in FIG. 20*a* and the entire mechanism 1800 is lowered. To raise the mechanism, both of the SMA wires 1803, 1804 are cooled, causing them to elongate and the bellows 1802 to expand vertically as shown in FIG. 20*b*. Combining the two motions requires a differential-drive approach, where the difference between the actuations produce the azimuth component, and the sum produces the elevation component.

The main advantage of the bellows mechanism 1800 is that it has a low part count, reducing manufacturing costs and design complexity. In addition, due to the hollow cylinder 1801, the bellows mechanism allows room for additional components such as a battery and controller. These benefits, however, come at the cost of an increase in control complexity because both the azimuth and elevation motion are coupled in the mechanism.

Example 3

Leaf Spring

Figure 21:
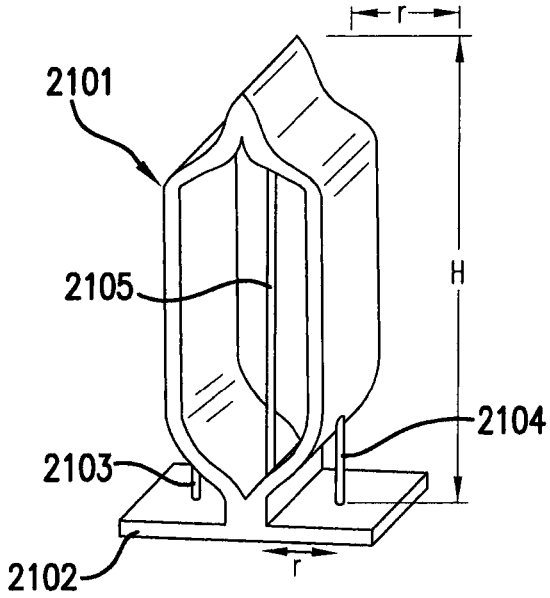
FIG. 21 is a perspective view of a leaf spring platform mechanism according to an embodiment of the invention.

The leaf spring mechanism 2100 shown in FIG. 21 is another type of actuator that uses rotational motion to achieve a linear azimuth motion due to small angles. However, unlike the bellows actuator 2100, control of the elevation and azimuth motions is decoupled. The motions themselves are merged through an intrinsically coupled series type architecture. Due to the compliant structure of the leaf spring 2102, both a vertical and rotational stiffness are present, allowing SMA wires to reset after being cooled. Like the bellows mechanism, motion in the azimuth direction for the leaf spring possesses leveraging with a mechanical advantage directly proportional to the distance ratio r/H, while there is no leveraging for the elevation direction. The leaf spring mechanism 2100, from the concept tree (FIG. 13), consists of a rotational leaf spring leverage type, straight wire angle, decoupled wire connectivity, single wire assembly, spring reset type for elevation, antagonistic reset type for rotation, direct wire packaging, and an intrinsic coupler.

The leaf spring platform mechanism comprises a leaf spring 2101 attached to a base 2102. An SMA wire 2103 is attached to the left side of the leaf spring 2101, and another SMA wire 2104 is attached to the right side. A third SMA wire 2105 is attached between the middle of the top and bottom of the leaf spring 2101.

Figure 22A:
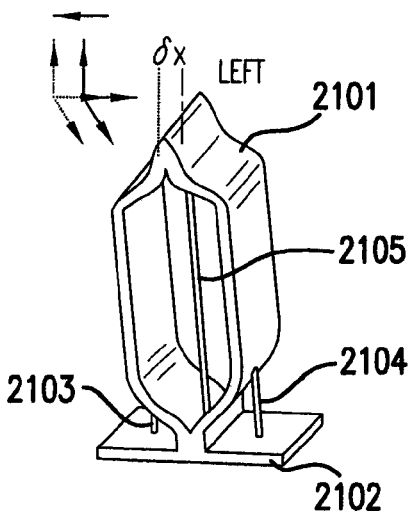
FIGS. 22*a* and 22*b* are perspective views of the leaf spring platform mechanism of FIG. 21 activated to the left and right, respectively.
Figure 22B:
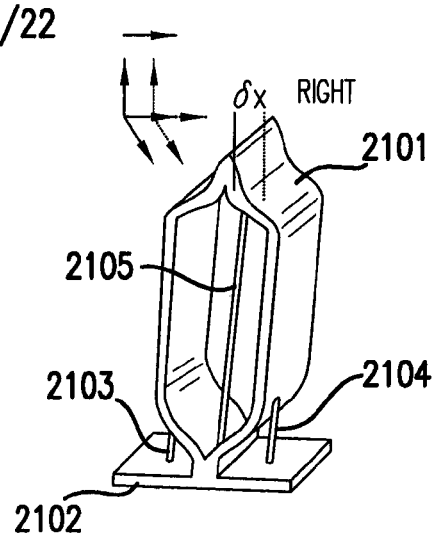
Figure 23A:
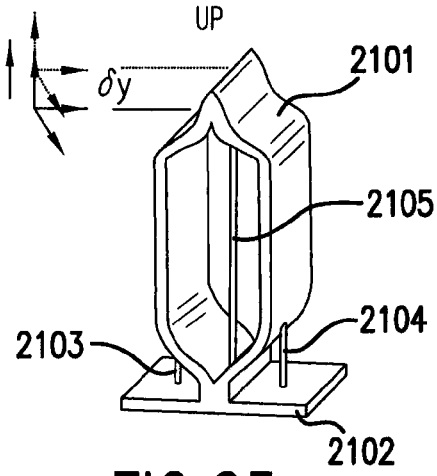
FIGS. 23*a* and 23*b* are perspective views of the leaf spring platform mechanism of FIG. 21 activated up and down, respectively.
Figure 23B:
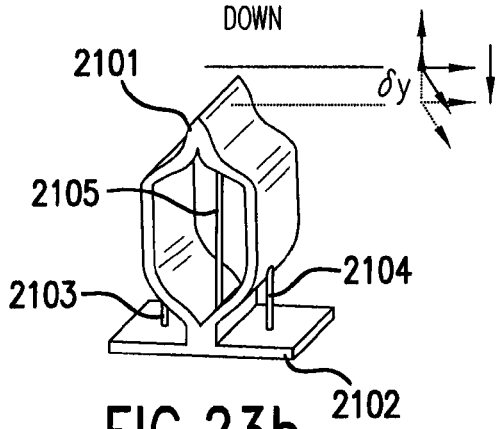

Moving the leaf spring platform 2100 in the azimuth direction is done by heating one of the SMA wires attached to the sides of the compliant structure. For example, to move the platform 2100 to the left as shown in FIG. 22*a*, the left SMA wire 1803 is heated, causing it to contract. This forces the left SMA wire 1804 to elongate, and also forces the leaf spring 2101 to rotate counter-clockwise. Because of the small angle of rotation, this translates to a linear azimuth motion to the left. Similarly, the right SMA wire 2104 is heated to rotate the leaf spring 2101 in the clockwise direction, producing an azimuth motion to the right as shown in FIG. 22*b*. Vertical motion is achieved by heating the inner SMA wire 2105 as shown in FIG. 23. When this wire 2105 is heated, it contracts and forces the leaf spring 2101 to compress downward as shown in FIG. 23*b*. An upward motion is produced by cooling the SMA wire 2105, allowing the internal stiffness of the leaf spring 2101 to force the wire 2105 to elongate and also force the platform 2100 up as shown in FIG. 23*a*.

Figure 24:
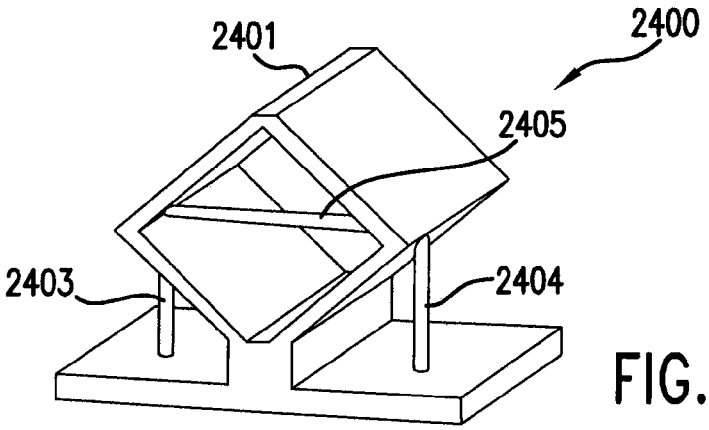
FIG. 24 is an alternative leaf spring platform mechanism according to yet another embodiment of the invention.

As discussed, the Leaf Spring is capable of delivering a mechanical advantage for motions in the azimuth direction. However, as depicted in FIGS. 21-23, there is no leverage for elevation, requiring a long SMA wire 2105. If packaging were an issue, an elevation lever (Appx. A.) could be incorporated into the design. For example, the SMA diamond mechanism (Appx. A.LX.2) may be embedded in a leaf spring 2401 as shown FIG. 24, allowing for a compact design that produces leverage in both the elevation and azimuth directions. Counter-clockwise and clockwise rotation are accomplished by alternatively heating the right and left SMA wires 2403, 2404 similar to the manner discussed above. However, in this configuration, heating the center SMA wire 2105 causes an upward movement while cooling the wire 2105 results in a downward movement.

Because the elevation and azimuth controls are fully decoupled, the leaf spring mechanism avoids the complexities in controllability present in the bellows mechanism. In addition, the leaf spring shares the benefits of the bellows mechanism in that it is simple to manufacture and design, and relatively low-cost. If a compliant structure were used, there would be a minimal amount of moving parts, eliminating problems of friction wear. The main design driver for the leaf spring is that it may potentially use more space than the other concepts presented, allowing little room for additional components. Design for compactness, however, is possible for this concept and it can still be made to function in the required volume.

Example 4

Levers

Figure 3A:
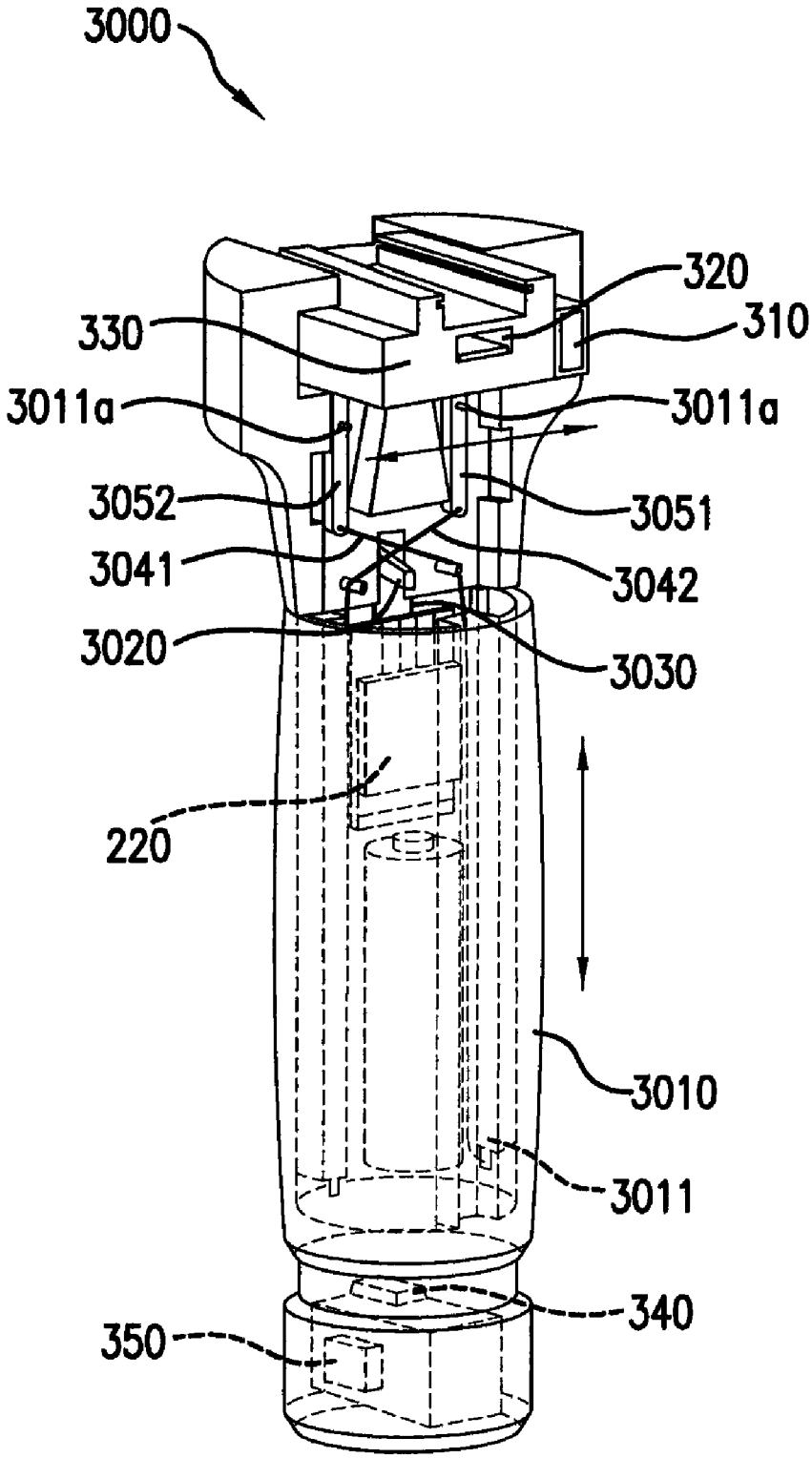
FIG. 3*a* is a cut away view of a stabilizing handgrip according to another embodiment of the invention.

Yet another example of a platform mechanism can be seen with reference back to the handgrip 3000 illustrated in FIG. 3*a*. The handgrip 3000 includes an outer sliding grip 3010 with an up/down translational bearing that allows the outer sliding grip 3010 to ride on an inner grooved core 3011. In order to produce up/down motion, a pair of SMA wire actuators 3030 are attached between posts on the bottom portion of the internal core 3011 and L-levers 3020 mounted on pins on the top portion of the same structure (one each of the elevation levers 3020 and SMA wires 3030 are illustrated in the cut away view of FIG. 3*a*). When the SMA wires 3030 are heated, causing them to contract, these levers 3020 push on the top edge of the outer sliding grip 3010 to cause downward motion as shown in FIG. 3*b*(2). A compliant spring (not shown in FIG. 3) is mounted at the bottom of the outer sliding grip 3010 and between the internal component mounting structure to cause return or upward motion of the outer sliding grip 3010 when the SMA wires are cooled as illustrated in FIG. 3*b*(2).

In an alternative embodiment, this system of SMA wires 3030 and L-levers 3020 is counter balanced by another set of counter acting (opposing) SMA wires and L-levers (not shown in FIG. 3). To effect a change in direction of the inner core 3011 and thereby lower the gun relative to the grip 3011 in such an alternative embodiment, the SMA wires 3030 are deactivated and the counter-acting SMA wires are activated.

Referring now back to FIG. 3*a*, the rail clamp bracket 330 slides on a bearing within the grip 3000, enabling precise low friction motion along an axis that is perpendicular to the axis of the barrel to allow for side-to-side (azimuth) linear motion. To produce side to side (azimuth) linear motion, two antagonistic SMA wire actuators 3041, 3042, are attached on one end to the base of the internal core 3011 and on the other to corresponding levers 3051, 3052 mounted on pivot pins 3011*a* at the top portion of the internal core 3011 of the handgrip 3000. When linear motion to the left is desired, SMA wire 3041 is activated, causing the end of lever 3051 opposite the end to which the SMA wire 3041 is attached to bear against the rail clamp bracket 330, which causes the rail mounting clamp 330 to move to the left relative to the handgrip 3000 as shown in FIG. 3*c*(1). Conversely, when movement to the right is desired, SMA wire 3042 is activated, causing end of the lever 3052 opposite the end to which the SMA wire 3042 is attached to bear against the rail mounting clamp 330 and thereby causing the rail mounting clamp 330 to move to the right relative to the handgrip 3000 as shown in FIG. 3*c*(2). Note that the structure 3060 acts as a limit on the travel of the levers 3051, 3052.

It will be recognized that many changes and modifications can be made to the preferred embodiments discussed above without departing from the spirit and scope of the invention. The preferred embodiments discussed above and illustrated in the attached drawings are illustrative only and should not be understood to limit the invention.

APPENDIX

Levers

LD. Direct Method

Figure 25A:
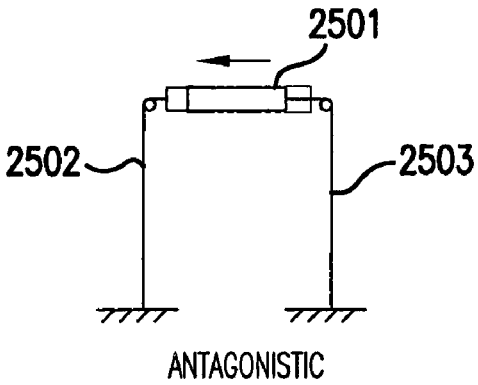
FIGS. 25-41 are schematic diagrams of various platform mechanisms according to still other embodiments of the invention.
Figure 25B:
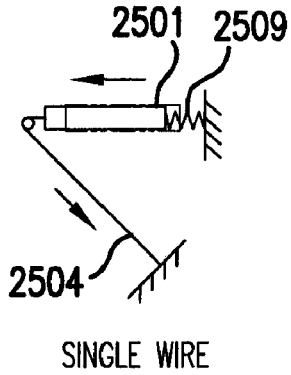

The direct method uses direct leveraging (mechanical advantage of 1), and the SMA wire(s) is used to connect the platform to ground. In the antagonistic case (FIG. 25*a*), to move the platform 2501 in the left direction, the SMA wire 2502 attaching to the left side of the platform 2501 is heated while the wire 2503 to the right of the platform 2502 is left cool. This forces the left wire 2502 to contract and the right wire 2503 to elongate, producing a leftward motion. The opposite is done to generate a rightward motion.

Figure 26A:
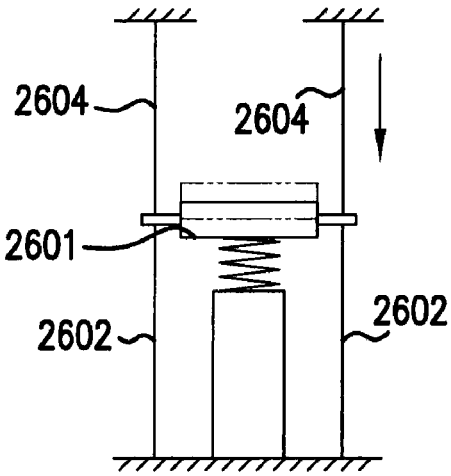
Figure 26B:
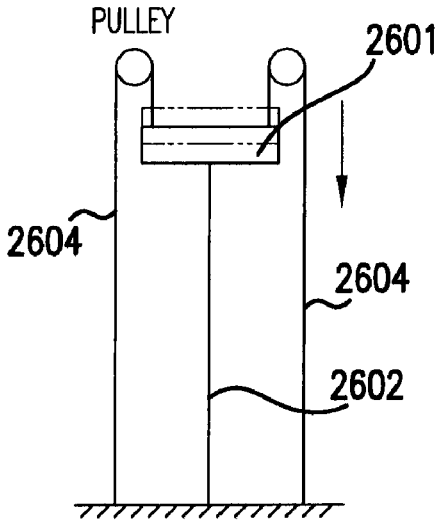
Figure 27A:
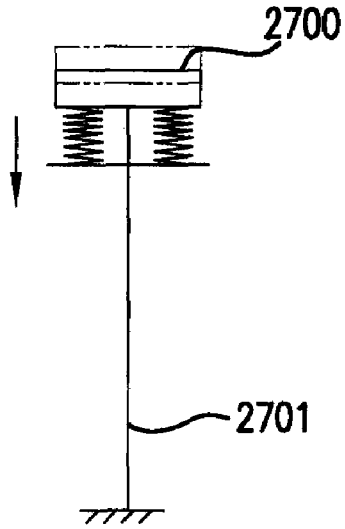
Figure 27B:
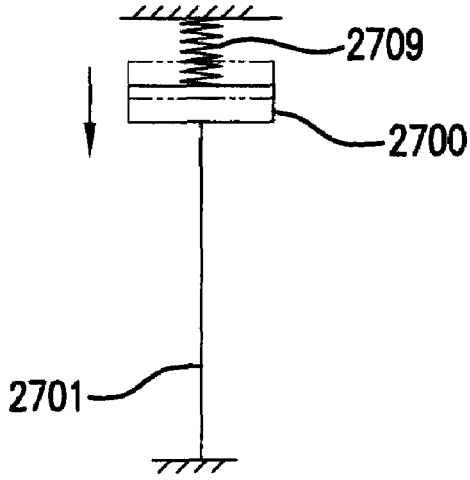

To move the platform down, in the antagonistic case (FIG. 26), the SMA wires 2602 attaching to the bottom side of the platform 2601 are heated while the wires 2604 attached to the top of the platform are left cool. This causes the bottom wire 2602 to contract and the top wire 2604 to elongate, producing a downward motion. The opposite is done to generate an upward motion. If a single wire were used for azimuth or elevation motion (FIGS. 25*a*, 27), the SMA wire 2504, 2701 is heated and contracts, producing motion toward the side that the wire is attached to, while also extending a spring 2509, 2709. To move the platform 2501, 2700 in the opposite direction, the wire 2504, 2701 is cooled and the spring forces the wire to elongate, and moves the platform 2501, 2700. The cycle is then repeated.

LL. Lever

Single-L

Figure 28A:
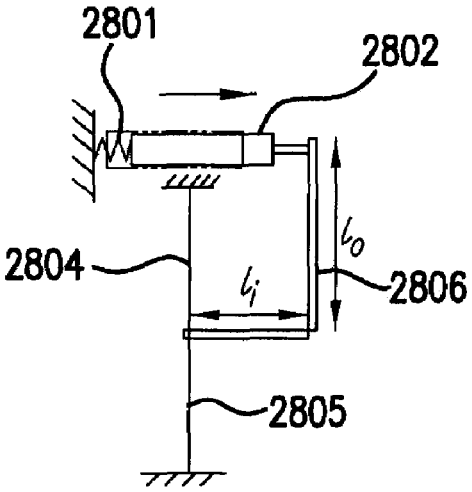
Figure 28B:
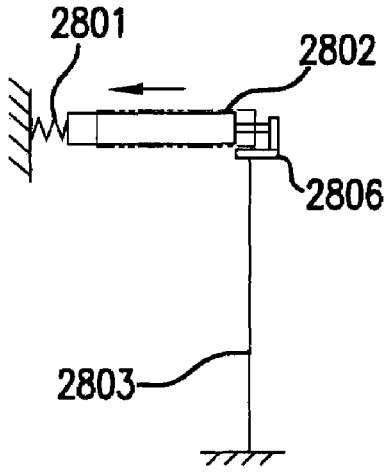

A spring 2801 is attached to one side of the platform 2802, while the other is actuated by single 2803 (FIG. 28*b*) or antagonistic 2804, 2805 wires (FIG. 28*b*) via a lever mechanism 2806. For a single wire 2803, the SMA is heated as shown, causing it to contract and force the lever to the left, compressing a spring 2801. The wire is cooled to produce a rightward motion when the spring expands and causes the wire to elongate. The cycle is repeated from this point. In the antagonistic case, the top wire 2804 is heated causing it to contract, elongate the bottom wire 2805, and force the platform 2802 to the right. The process is reversed to move the platform 2802 to the left, and the cycle is repeated. The mechanical advantage is equal to the input arm ($l_i$) divided by the output arm ($l_o$). Elevation motion is generated by rotating the mechanism 90 degrees and following the cycle described above.

Single-Conventional

Figure 29A:
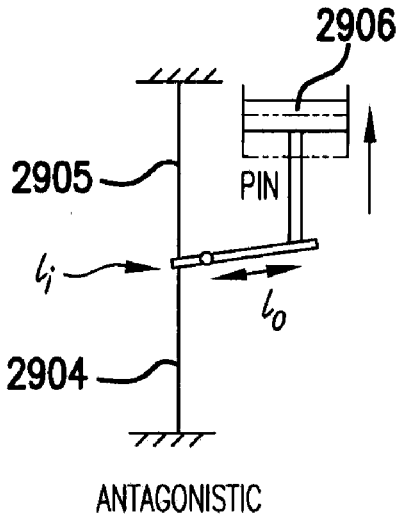
Figure 29B:
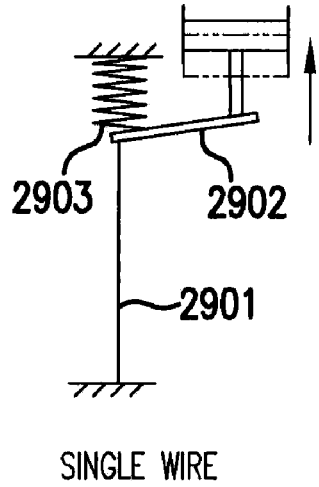
Figure 30:
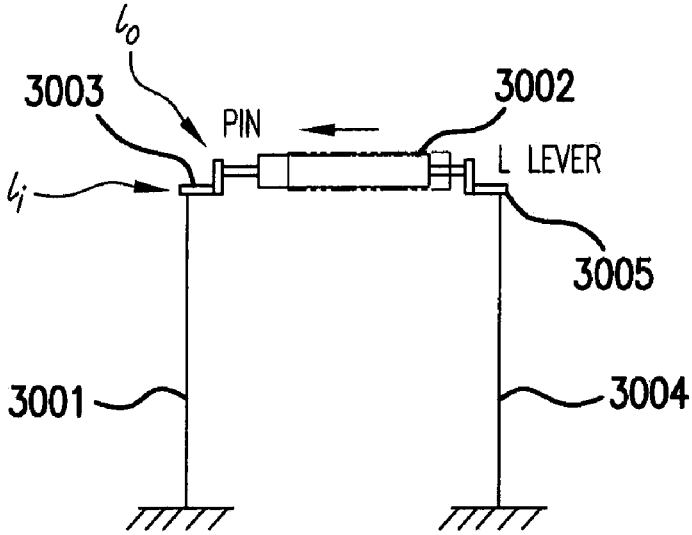
Figure 31:
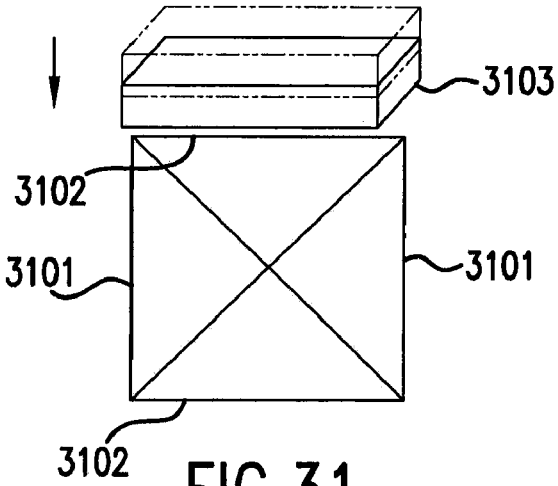
Figure 32:
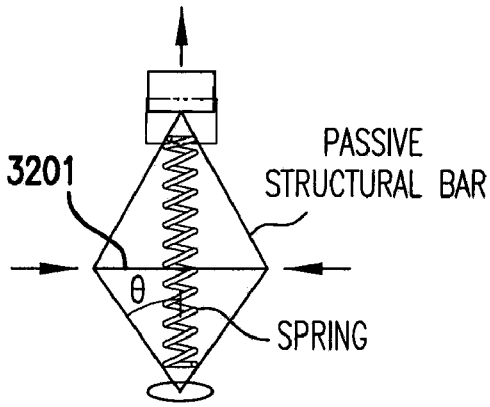
Figure 33:
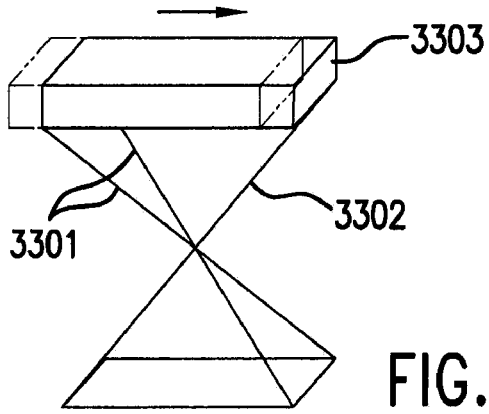
Figure 34:
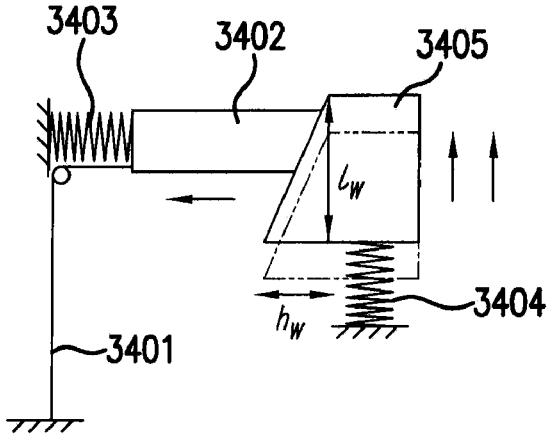

For a single wire (FIG. 29*b*), the SMA2901 is heated as shown, causing it to contract and force the lever 2902 upward, compressing a spring 2903. The wire 2901 is cooled to produce a downward motion when the spring 2903 expands and causes the wire 2901 to elongate. The cycle is repeated from this point. In the antagonistic case (FIG. 29*a*), the bottom wire 2904 is heated causing it to contract, elongate the top wire 2905, and force the platform 2906 upward. The process is reversed to move the platform 2906 down, and the cycle is repeated. Mechanical advantage is equal to the length of the input ($l_i$) arm divided by the output arm ($l_o$). Azimuth motion is achieved by rotating the mechanism 90 degrees.

Dual Lever

SMA 3001 is heated and contracts, causing a leftward motion of the slider 3002, attached to the wire 3001 through a lever 3003. The right wire 3004 is elongated is attached to the platform 3002 through another lever 3005 and is elongated in this process. Rightward motion is created by cooling the left SMA wire 3001 and heating the right wire 3004. The cycle is repeated. Mechanical advantage is equal to the length of the input ($l_i$) arm divided by the output arm ($l_o$). Elevation motion is achieved by rotating the mechanism 90 degrees.

LX. Scissors

1. X-Mechanism

Using a passive structural bar, a downward motion is produced by heating the SMA wires 3101 on the sides. This causes them to contract and thus elongate the cold SMA wires 3102 along the top and bottom of the mechanism. To produce upward motion, the process is reversed, and the SMA wires 3101 along the side are allowed to cool while the wires on the top and bottom 3102 are heated. The entire cycle is then repeated. By attaching the platform 3103 to the left or right sides of the structure, motion in the azimuth direction is produced. Mechanical advantage depends on the geometry of the passive structure and requires detailed analysis.

2. Diamond Mechanism

When the SMA wire 3201 is heated, it contracts causing the structure to expand vertically creating an upward motion. The wire 3201 is then cooled allowing a compliant structure or return spring to lower the device and elongate the SMA wire 3201, and the cycle repeats. Mechanical advantage varies through mechanism operation and requires detailed analysis. Azimuth motion is generated by rotating the mechanism 90 degrees.

LSh. Shearing Mechanism

The shearing mechanism constrains the platform 3303 to move only in the azimuth direction (or elevation direction if the mechanism is rotated 90 degrees). The mechanical advantage of this mechanism is a function of the angle the SMA wire makes with the platform. To move the platform 3303 to the right (or up), the SMA wires 3301 connecting to the left corners of the platform are heated causing them to contract while the other wires 3302 are left cool. Since the platform is constrained only to move in the azimuth direction, the hot SMA wires 3301 move the platform to the right. To move the platform to the left (or down), the SMA wires 3302 connecting to the right corners of the platform 3303 are heated while the rest of the wires 3301 are left cool. The cycle is repeated.

LW. Wedge

SMA 3401 is heated and contracts, which causes a leftward motion of the pin 3402 compressing the attached spring 3403. This allows the compression spring 3404 under the wedge 3505 (which is part of the platform) to move upward. The SMA wire 3401 is then cooled allowing the compression spring 3403 attached to the pin 3402 to force the platform 3405 downward. The cycle repeats from this point. Mechanical advantage is equal to the length of the inclined plane ($l_w$) of the wedge divided by its height ($h_w$). Azimuth motion is generated by rotating the entire mechanism 90 degrees.

LSI. SMA Slider

Figure 35A:
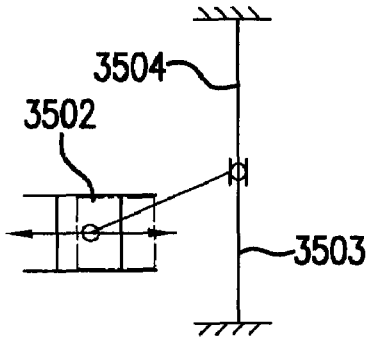
Figure 35B:
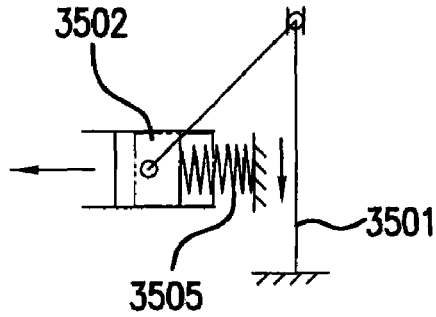
Figure 36:
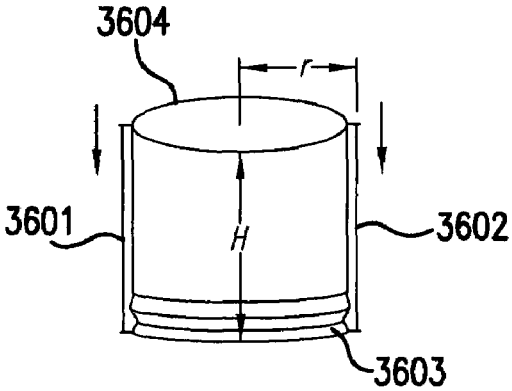
Figure 37:
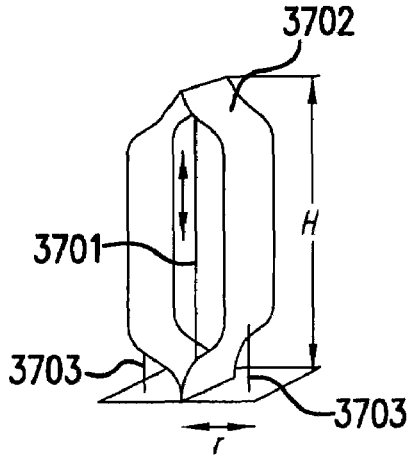
Figure 38:
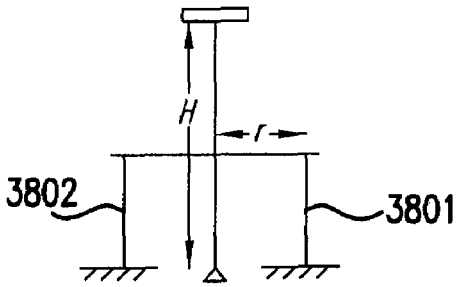
Figure 39A:
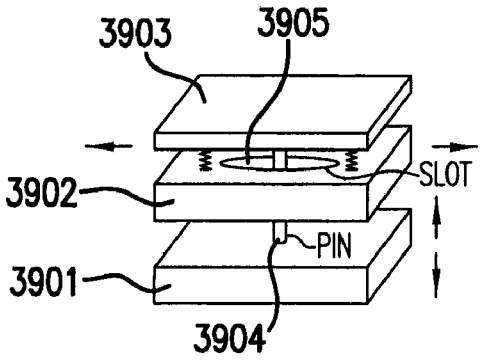
Figure 39B:
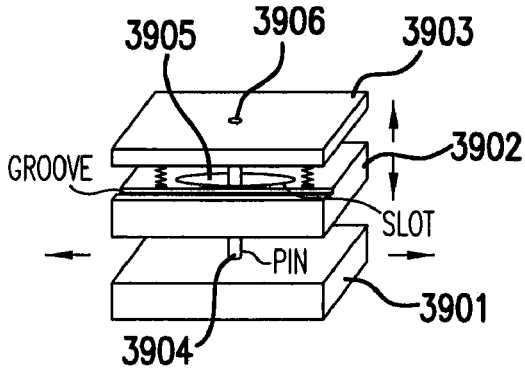

The SMA slider produces a mechanical advantage that varies through the actuation cycle and requires detailed analysis. SMA is heated and contracts, which causes a leftward motion of the slider 3502. In the antagonistic case (FIG. 35*a*), the bottom wire 3503 is heated, elongating the top wire 3504 which is left cool. In the case with a single wire 3501 (FIG. 35*b*), a spring 3505 is attached to the slider. To move the platform 3502 to the right, the hot and cold wires are reversed for the antagonistic case. In the case with a single wire the SMA is allowed to cool allowing the spring 3503 to force the slider 3502 to the right. The cycle is then repeated. Elevation motion is achieved by rotating the mechanism 90 degrees.

LR. Rotational

The three rotational lever mechanisms presented here also serve as intrinsic couplers, and appear on the concept tree as IC.1, IC.2, and IC.3 as well as LR.1, LR.2, and LR.3.

1. Bellows Mechanism

The Bellows mechanism consists of two SMA wires 3601, 3602 that achieve both azimuth and elevation motion. To move the mechanism down, both SMA wires 3601, 3602 are heated causing them to contract. This causes the bellows 3603 to compress and thus lower the platform 3604. To raise the platform 3604, both SMA wires 3601, 3602 are cooled and the bellows 3603 are allowed to expand. Moving the platform to the right is accomplished by cooling the left wire 3601 and heating the right 3602. This causes the platform 3604 to rotate, and for small angles approximates to a linear rightward azimuth motion. The operation is reversed to move the platform to the left. Azimuth mechanical advantage is directly proportional to the ratio r/H.

2. Leaf Spring

To elevate the platform, the inner wire 3701 is heated causing it to contract. This compresses the compliant structure 3702 causing the platform to lower. To raise the platform, the inner SMA wire 3701 is allowed to cool allowing the compliant structure 3702 to restore its original shape. Azimuth motion is achieved by heating one of the wires 3703 attached to the side of the structure and allowing the other to cool. This causes the structure to rotate, and for small angles translates to linear azimuth motion. Azimuth mechanical advantage is directly proportional to the distance r from the axis of the cylinder to the SMA attachment point divided by H, the height of the leaf spring.

3. Cross

To move the platform towards the right, the right SMA wire 3801 is actuated while the left wire 3802 is kept cool. This causes a rotational motion that, due to small angles, translates to a linear motion in the azimuth direction. Heating the wire 3802 to the left and leaving the right wire 3801 cool produces the opposite effect. Mechanical advantage is directly proportional to the distance r from the axis of the cross divided by the height of the pointer, H. To produce motion in the elevation direction, the mechanism is rotated 90 degrees.

Azimuth and Elevation Coupling Mechanisms

CE.1. Slotted Pin Extrinsic Coupler

These mechanisms are used to couple parallel type actuation. The azimuth and elevation motion are attached to either the bottom 3901 or middle 3902 plate, while the top plate 3903 is coupled to the rail adaptor. A pin 3904 is attached to the bottom plate 3901, passing through a slot 3905 in the middle plate 3902. When the elevation motion is attached to the bottom plate 3901, this pin 3904 is rigidly attached to the top plate 3903. Also, rails or compression springs are added between the middle 3902 and top 3903 plates to restrict relative horizontal motion, and only allow relative vertical motion. If the elevation motion is attached to the middle plate, the pin 3904 passes through a hole 3906 in the top plate 3903.

CE.2. Rail System Extrinsic Coupler

Figure 40:
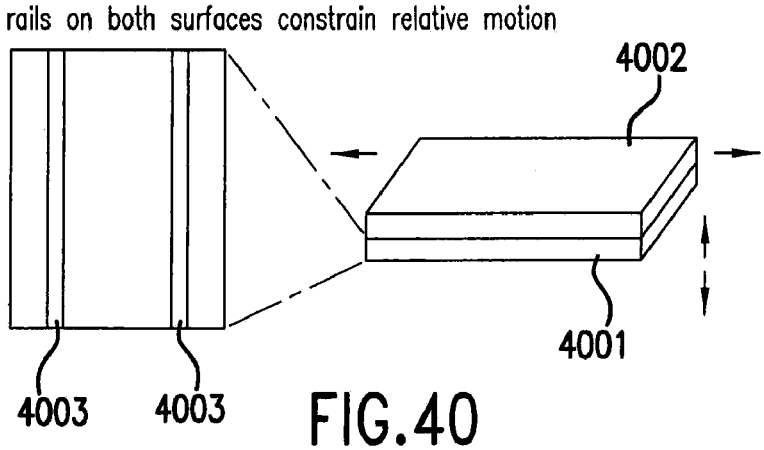
Figure 41:
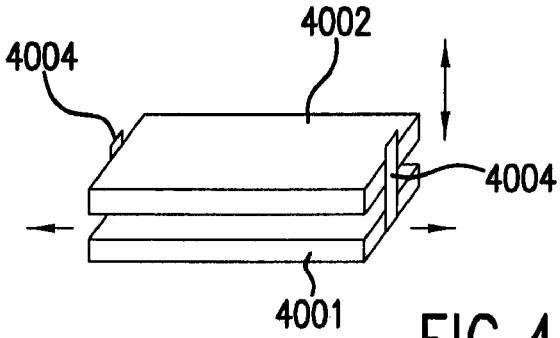

These mechanisms are used to couple series type actuation. The azimuth and elevation motion are attached to either the bottom 4001 or top plate 4002, and the top plate 4002 is coupled to the rail adaptor. If azimuth motion occurs on the top plate (FIG. 40), rails 4003 are fitted on both surfaces to allow this relative motion, but constrain relative elevation. If the azimuth motion occurs on the bottom plate (FIG. 41), rails 4004 are built on the sides of the plates 4001, 4002 constraining this relative motion, but allowing relative elevation.

REFERENCES

Background a. FM3-22.9 Rifle Marksmanship M16A1, M16A2/3, M16A4 and M4 CARBINE, Headquarters of the U.S. Army, Chapter 4, April 2003.

b. FM 23-10 Sniper Training. Headquarters of the U.S. Army. Washington D.C. August 1994.

c. Joint Publication 3-06, Doctrine for Joint Urban Operations, 16 Sep. 2002, page vii.

d. David, William C., "Preparing a Battalion for Combat: Marksmanship", Infantry, July/August 1995, pp 27-30.

e. FM3-22.9, Rifle Marksmanship M16A1, M16A2/3, M16A4 and M4 CARBINE, Headquarters of the U.S. Army, Chapter 7-29, April 2003.

f. Personal Conversation with B. Galeazzi, U.S. Army ARDEC, Picatinny Arsenal, N J, Mar. 19, 2001.

g. Broden, David, "Revolutionizing Combat Capability," Global Defense Review, 1999.

h. Grossman, D., & Siddle, B. K., "Psychological Effects of Combat," in Encyclopedia of Violence, Peace and Conflict, Academic Press, 2000.

i. Siddle, Bruce K. Sharpening the Warrior's Edge, Millstadt, IL: PPCT Research Publications, 1995.

Detailed Description

1. B. Barnes, D. Brei, J. Luntz, C. Lavigna, November 2005, "Development of an Antagonistic SMA Actuator for INSTAR Stabilization System", ASME, Orlando Fl.

2. D. Brei, J. Vendlinski, D. K. Lindner, H. Zhu, C. LaVigna, March 2003, "Development and Demonstration of INSTAR-Inertially Stabilized Rifle", SPIE Smart Structures and Materials, San Diego, Calif., v 5056, p. 255-266.

3. D. Brei, J. Vendlinski, M. Frecker, S. Bharti, March, 2003, "Actuation Development and Evaluation for INSTAR—Inertially Stabilized Rifle", SPIE Smart Structures and Materials, San Diego, Calif., v 5056, 2003, p 338-355

4. www.smartmaterials.info/materials/comparison 5. http://web.mit.edu/bobohand/www/gerver/www/fsma/a/index.html 6. Shaw, J. A. (2000), Simulations of localized thermo-mechanical behavior in a NiTi shape memory alloy., Int. J. Physics 16, pp. 541-562.

7. Shaw, J. A., and Kyriakides, S. (1997), On the nucleation and propagation of phase transformation fronts in a NiTi Alloy., Acta mater. Vol. 45, No. 2, pp. 683-700.

8. Shaw, J. A., and Kyriakides, S. (1996), Thermomechanical aspects of NiTi., J. Mech. Phys. Solids, Vol. 43, No. 8, pp. 1243-1281.

9. Murry, S. J., Marioni, M., Allen, M. S., O'Handley, R. C., and Lograsso, T. A. (2000), 6% magnetic-field-induced strain by twin-boundary motion in ferromagnetic Ni—Mn—Ga., Appl. Phys. Lett. 77, 867.

10. Chopra, I. (1996), Review of current status of Smart Structures and Integrated Systems., Smart Structures and Materials 1996: Smart Structures and Integrated Systems, I. Chorpa, Ed., Proc. SPIE 2717, SPIE, Bellingham, Wash., pp. 20-62.

11. www.smartmaterials.info/materials/comparison/qualitative_comparison.html 12. http://ndeaa.jpl.nasa.gov/nasa-nde/lommas/eap/actuators-comp.pdf 13. Zhang, Q., Bharti, V., Zhao, X., "Giant Electrostriction and Relaxor Ferroelectric Behavior in Electron-Irradiated Poly(vinylidene fluoride-trifluorethylene) Copolymer," Science, Vol. 280, pp. 2101-2104, Jun. 26, 1998.

14. Tobushi, J. Hayashi, S. and Kojima, S., "Mechanical Properties of Shape Memory polymer of Polyurethane Series," JSME International Journal, Series I, Vol. 34, No. 3, 1992.

15. Baughman, R., Shacklette, L. Elsenbaumer, R., Pichta, E., Becht, C., 1990, "Conducting Polymer Electromechanical Actuators, "Conjugated Polymeric Materials: Opportunities in Electronics, Optoelectronics and Molecular Electronics, Ed. J. K. Bredas and R. R. Chance, Kluwer Academic Publishers, pp. 559-582, 1990.

16. Shahinpoor, M., "Micro-electro-mechanics of Ionic Polymer Gels as Electrically controllable Artificial Muscles," J. Intelligent Material Systems and Structures, Vol. 6, pp. 307-314, 1995.

17. Oulu University—http://herkules.oulu.fi/isbn9514252217/html/x317.html

18. Mabe, J. H., Ruggeri, R. T, Rosenweig, E. and Yu, C.-J., "NiTinol Performance Characterization and Rotary Actuator Design," in Proceedings: SPIE 5388-11 Smart Structures and Materials Conference, San Diego, Calif., March 2004.

19. Digikey Website, www.digikey.com

What is claimed is:

1. A handgrip for stabilizing a hand-held device, the handgrip comprising:

a handgrip housing, the handgrip housing being connectable to the hand-held device;

a power supply;

a controller connected to the power supply;

a sensor connected to the controller, the sensor being operable to detect movement of the hand-held device along a first axis and along a second axis;

an actuator connected to the controller, the actuator being operable to produce a force under the control of the controller;

a platform mechanism, the platform mechanism being operable to transfer a force exerted by the actuator to a force exerted between the handgrip and the hand-held device;

wherein the actuator and the platform mechanism are located within the handgrip housing; and further wherein said handgrip housing is separately detachable from said hand-held device.

2. The handgrip of claim 1, wherein the actuator comprises at least one shape memory alloy (SMA) wire.

3. The handgrip of claim 1, wherein the SMA wire is a nitinol SMA wire.

4. The handgrip of claim 1, wherein the controller is configured in a feedback configuration.

5. The handgrip of claim 1, wherein the controller is configured in a feedback/feedforward configuration.

6. The handgrip of claim 1, wherein the controller is implemented using a technique selected from the group consisting of linear quadratic Gaussian (LQG), linear quadratic regulator (LQR), H-infinity, proportional-integral-derivative (PID), and neural networks.

7. The handgrip of claim 1, wherein the platform mechanism is a direct platform mechanism.

8. The handgrip of claim 1, wherein the platform mechanism comprises a base;

an azimuth actuator plate disposed over and engageable with an upper horizontal surface of the base such that the azimuth actuator plate may move in a horizontal direction;

an elevation actuator plate engageable with a vertical member of the base such that the elevation actuator plate may move in a vertical direction but is constrained from moving in a horizontal direction;

an top plate engageable with the elevation actuator plate and the azimuth actuator plate such that the top plate may move in a horizontal direction with respect to the elevation actuator plate and may move in a vertical direction with respect to the azimuth actuator plate;

wherein the azimuth actuator plate is attached to at least a first SMA wire for movement in a horizontal direction with respect to the base and wherein the elevation actuator plate is attached to at least a second SMA wire for movement in a vertical direction with respect to the base.

9. The handgrip of claim 8, wherein the azimuth actuator plate further comprises an upstanding pin, the pin being positioned to pass through a slot in the elevation actuator plate and engage a hole formed in the top plate, whereby the top plate is constrained from moving in a horizontal direction with respect to the bottom plate but is not constrained from moving in a vertical direction with respect to the bottom plate.

10. The handgrip of claim 1, wherein the platform mechanism is a rotational platform.

11. The handgrip of claim 10, wherein the rotational platform is a bellows platform.

12. The handgrip of claim 11, wherein the bellows platform comprises a hollow cylinder attached to a flexible bellows, the hollow cylinder further being attached to a first SMA wire on a first side of the cylinder and a second SMA wire on a second side of the cylinder.

13. The handgrip of claim 10, wherein the rotational platform is a leaf spring platform comprising a leaf spring, a first SMA wire attached to a first side of the leaf spring and a second SMA wire attached to a second side of the leaf spring.

14. The handgrip of claim 13, further comprising a third SMA wire oriented parallel to a major axis of the leaf spring.

15. The handgrip of claim 13, further comprising a third SMA wire oriented perpendicular to a major axis of the leaf spring.

16. The handgrip of claim 1, wherein the platform mechanism comprises an outer grip slidably engageable with the handgrip body;

a first SMA wire;

an elevation lever pivotably attached to an inner surface of the handgrip body, with lever being positioned such that it bears on the outer grip when the first SMA wire is activated, whereby relative movement between the slidable outer grip and the inner surface of the handgrip body is produced when the first SMA wire is activated.

17. The handgrip of claim 16, further comprising a mount slidably engaged with an upper portion of an inner surface of the handgrip body a second SMA wire attached at one end to a lower portion of the inner surface of the handgrip body;

a second lever pivotably attached to the amount, a second end of the second SMA wire being attached to the second lever;

a third SMA wire attached at one end to a lower portion of the inner surface of the handgrip body; and a third lever pivotably attached to the mount, a second end of the third SMA wire being attached in the third lever;

wherein the second and third levers are positioned such that they contact a portion of the inner surface of the handgrip body, thereby causing relative movement between the mount and the hand-held device when either of the second and third SMA wires are activated.

18. The handgrip of claim 1, wherein the sensor comprises a first gyro oriented to detect movement along the first axis and a second gyro oriented to detect movement along a second axis.

19. The handgrip of claim 1, wherein the controller, the sensor, and the power supply are located within the handgrip housing.

20. The handgrip of claim 1, wherein the actuator converts electrical energy to a mechanical force.

21. The handgrip of claim 1, wherein the actuator converts electrical energy to a mechanical force.

22. A method for stabilizing a hand-held device comprising the steps of:

detecting a motion of the hand-held device along a first axis and along a second axis using a sensor mounted in a handgrip housing, the motion resulting from an undesirable force exerted on the hand-held device by an operator of the hand-held device;

calculating a force necessary to counteract the motion resulting from the undesirable force using a controller;

controlling an actuator to produce a stabilizing force that counteracts the undesirable force;

transferring the stabilizing force produced by the actuator to a force exerted between the handgrip and the hand-held device;

wherein the controller, the sensor, and the actuator are located within a handgrip housing attached to the hand-held device;

wherein said handgrip housing is separately detachable from said hand-held device.

23. The method of claim 22, wherein a power source for the actuator is also located within the handgrip housing.

24. The method of claim 22, wherein the actuator comprises at least one SMA wire.

* * * * *